US012637267B2

(12) United States Patent
Arif

(10) Patent No.: US 12,637,267 B2
(45) Date of Patent: May 26, 2026

(54) LID ASSEMBLY FOR A CONTAINER

(71) Applicant: Rajwan Mohammad Arif, Casa Grande, AZ (US)

(72) Inventor: Rajwan Mohammad Arif, Casa Grande, AZ (US)

( * ) Notice: Subject to any disclaimer, the term of this patent is extended or adjusted under 35 U.S.C. 154(b) by 214 days.

(21) Appl. No.: 18/496,338

(22) Filed: Oct. 27, 2023

(65) Prior Publication Data

US 2025/0136334 A1 May 1, 2025

(51) Int. Cl.
*B65D 51/16* (2006.01)

(52) U.S. Cl.
CPC ..... *B65D 51/1688* (2013.01); *B65D 2205/02* (2013.01)

(58) Field of Classification Search
CPC ..... B65D 2205/02; B65D 51/1672; B65D 51/1683; B65D 51/1688
USPC ..... 141/65; 215/262, 307, 309, 311, 315; 220/231, 366.1, 367.1, 368, 373, 374
See application file for complete search history.

(56) References Cited

U.S. PATENT DOCUMENTS 3,415,357 A 12/1968 Van Natter
3,672,114 A 6/1972 Sacks
4,019,629 A 4/1977 Dubner et al.
4,278,114 A * 7/1981 Ruberg ..... A23B 2/103 53/103
4,815,628 A 3/1989 Wehnert, III
4,981,233 A * 1/1991 Scheurer ..... B65B 31/046 220/793
6,352,165 B1 * 3/2002 DiFelice ..... B65B 31/046 141/24
6,994,227 B2 * 2/2006 Kwon ..... A47J 47/10 220/203.11
8,701,910 B1 * 4/2014 Michalopoulos .. B65D 81/2038 417/478
9,096,365 B2 * 8/2015 Kim ..... B65D 81/2038
2006/0021991 A1 2/2006 Liu
2006/0060584 A1 3/2006 Onoda
2013/0071170 A1 * 3/2013 Mehus ..... F16L 37/32 222/145.5
2014/0231428 A1 8/2014 Ahmose

* cited by examiner

*Primary Examiner* — Nathan J Jenness
*Assistant Examiner* — Madison L Poos
(74) *Attorney, Agent, or Firm* — Parsons & Goltry, PLLC; Michael W. Goltry; Robert A. Parsons

(57) ABSTRACT

A lid assembly for a container includes a housing including a closure, a first vent, and a second vent. The housing defines a receiving area and a gas flow pathway. The gas flow pathway extends between the first vent, allowing gas transfer between the receiving area and the gas flow pathway, and the second vent, allowing gas transfer between the gas flow pathway and an atmosphere. An extensible and collapsible bellows coupled to the housing includes an open distal end open to the receiving area and the first vent and configured to fit over the container. The bellows is adjustable between an extended position, extended outward of the receiving area to the open distal end, and a collapsed position, compressed in the receiving area between the first vent and the open distal end. The closure is movable into and out of a closed position closing the first vent.

24 Claims, 19 Drawing Sheets

LID ASSEMBLY FOR A CONTAINER

FIELD OF THE INVENTION

The present invention relates to closures configured to close and develop positive pressures within containers.

DESCRIPTION OF RELATED ART

Pressurizing an opened container containing perishable goods, such as food or beverages, can offer several benefits. Pressurized containers can help prevent contamination from the outside environment. Maintaining a higher pressure inside makes it more difficult for external substances or impurities to enter the container. Food or beverages can have a longer shelf life when stored in pressurized containers. Increased helps preserve freshness and prevent spoilage by reducing the growth of bacteria and other microorganisms.

In response to consumers' needs, the prior art provides various closures configured to close and develop positive pressure inside containers of perishable goods. However, existing closures are not entirely satisfactory, unreliable, expensive, and impracticable, necessitating continued improvement in the art.

SUMMARY OF THE INVENTION

According to the invention, a lid assembly for a container includes a housing and an extensible and collapsible bellows coupled to the housing. The housing includes a closure, a first vent, and a second vent. The housing defines a receiving area and a gas flow pathway. The gas flow pathway extends between the first vent, allowing gas transfer between the receiving area and the gas flow pathway, and a second vent, allowing gas transfer between the gas flow pathway and an atmosphere. The bellows includes an open distal end. The open distal end is concurrently open to the receiving area and the first vent. The open distal end is configured to fit over the container. The bellows is adjustable between an extended position, extended outward of the receiving area to the open distal end, and a collapsed position, compressed in the receiving area between the first vent and the open distal end. The closure is movable into and out of a closed position closing the first vent. The lid assembly has an engagement assembly configured to secure the bellows in the collapsed position. The engagement assembly includes an engagement element carried by the housing and a complemental engagement element carried by the bellows. The engagement element is an internal thread, and the complemental engagement element is an external thread, the internal thread configured to thread over the external thread. The housing and the bellows are configured for relative rotation, allowing the external thread to thread over the internal thread in response to relative rotation between the housing and the bellows. The open distal end includes a collar configured with the external thread. The closure is movable rotatably into and out of the closed position. The housing surrounds the bellows when the bellows is in the collapsed position. The first vent is a pressure relief valve. The housing extends radially outward from the bellows. The gas flow pathway includes a radial component extending radially outward to a circumferential component, the first vent allowing gas transfer between the receiving area and the radial component and the second vent allowing gas transfer between the circumferential component and the atmosphere. The bellows has an open proximal end mounted for reciprocal movement through receiving area in opposition to the first vent, the open proximal end open to the receiving area, the first vent, and the open distal end. The receiving area is defined by an annular sidewall extending between an annular groove adjacent to the hole and a partition wall between the gas flow pathway and the receiving area, the partition wall configured with the first vent. The open proximal end includes a gasket within the receiving area, the gasket constrained for reciprocal movement along the annular sidewall by and between the annular groove and the dividing wall.

According to the invention, a lid assembly for a container includes a housing and an extensible and collapsible bellows coupled to the housing. The housing includes a closure, circumferentially spaced first vents, and circumferentially spaced second vents. The housing defines a receiving area and a gas flow pathway. The gas flow pathway extends between the first vents, allowing gas transfer between the receiving area and the gas flow pathway, and the second vents, allowing gas transfer between the gas flow pathway and an atmosphere. The bellows includes an open distal end. The open distal end is concurrently open to the receiving area and the first vent. Th open distal end is configured to fit over the container. The bellows is adjustable between an extended position, extended outward of the receiving area to the open distal end, and a collapsed position, compressed in the receiving area between the first vent and the open distal end. The closure is movable into and out of a closed position closing the first vents concurrently. The lid assembly has an engagement assembly configured to secure the bellows in the collapsed position. The engagement assembly includes an engagement element carried by the housing and a complemental engagement element carried by the bellows. The engagement element is an internal thread and the complemental engagement element is an external thread, the internal thread configured to thread over the external thread. The housing and the bellows are configured for relative rotation, allowing the external thread to thread over the internal thread in response to relative rotation between the housing and the bellows. The open distal end includes a collar configured with the external thread. The closure is movable rotatably into and out of the closed position. The housing surrounds the bellows when the bellows is in the collapsed position. Each first vent includes a pressure relief valve. The housing extends radially outward from the bellows. The gas flow pathway includes a radial component extending radially outward to a circumferential component, the first vents allowing gas transfer between the receiving area and the radial component and the second vents allowing gas transfer between the circumferential component and the atmosphere. The bellows has an open proximal end mounted for reciprocal movement through receiving area in opposition to the first vents, the open proximal end open to the receiving area, the first vents, and the open distal end. The receiving area is defined by an annular sidewall extending between an annular groove adjacent to the hole and a partition wall between the gas flow pathway and the receiving area, the partition wall configured with the first vents. The open proximal end includes a gasket within the receiving area, the gasket constrained for reciprocal movement along the annular sidewall by and between the annular groove and the dividing wall.

BRIEF DESCRIPTION OF THE DRAWINGS

Specific objects and advantages of the invention will become apparent to those skilled in the art from the following detailed description of illustrative embodiments thereof, taken in conjunction with the drawings in which.

DETAILED DESCRIPTION

Figure 1:
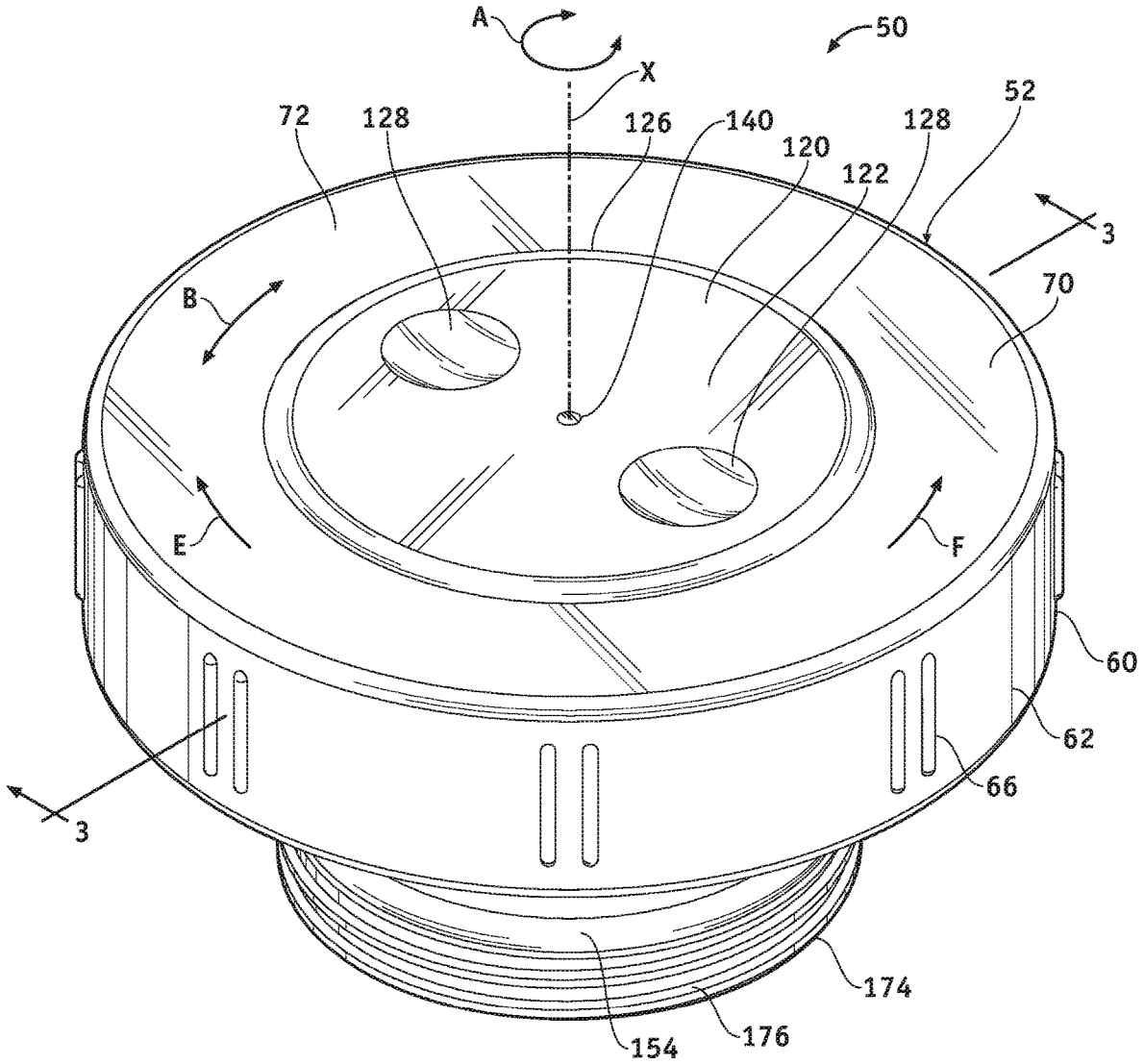
FIG. 1 is top perspective view of a lid assembly for a container, the lid assembly constructed and arranged according to the invention and including a housing, configured with a closure, and an extensible and collapsible bellows coupled to the housing.

Turning now to the drawings, like reference characters indicating corresponding elements throughout the several views, attention is directed to FIGS. 1-6 illustrating a lid assembly 50 for a container, for easily and efficiently closing and developing positive pressure within the container. The lid assembly 50, arranged about a central axis X, includes a housing 52 and an extensible and collapsible bellows 54 coupled to the housing 52.

Figure 2:
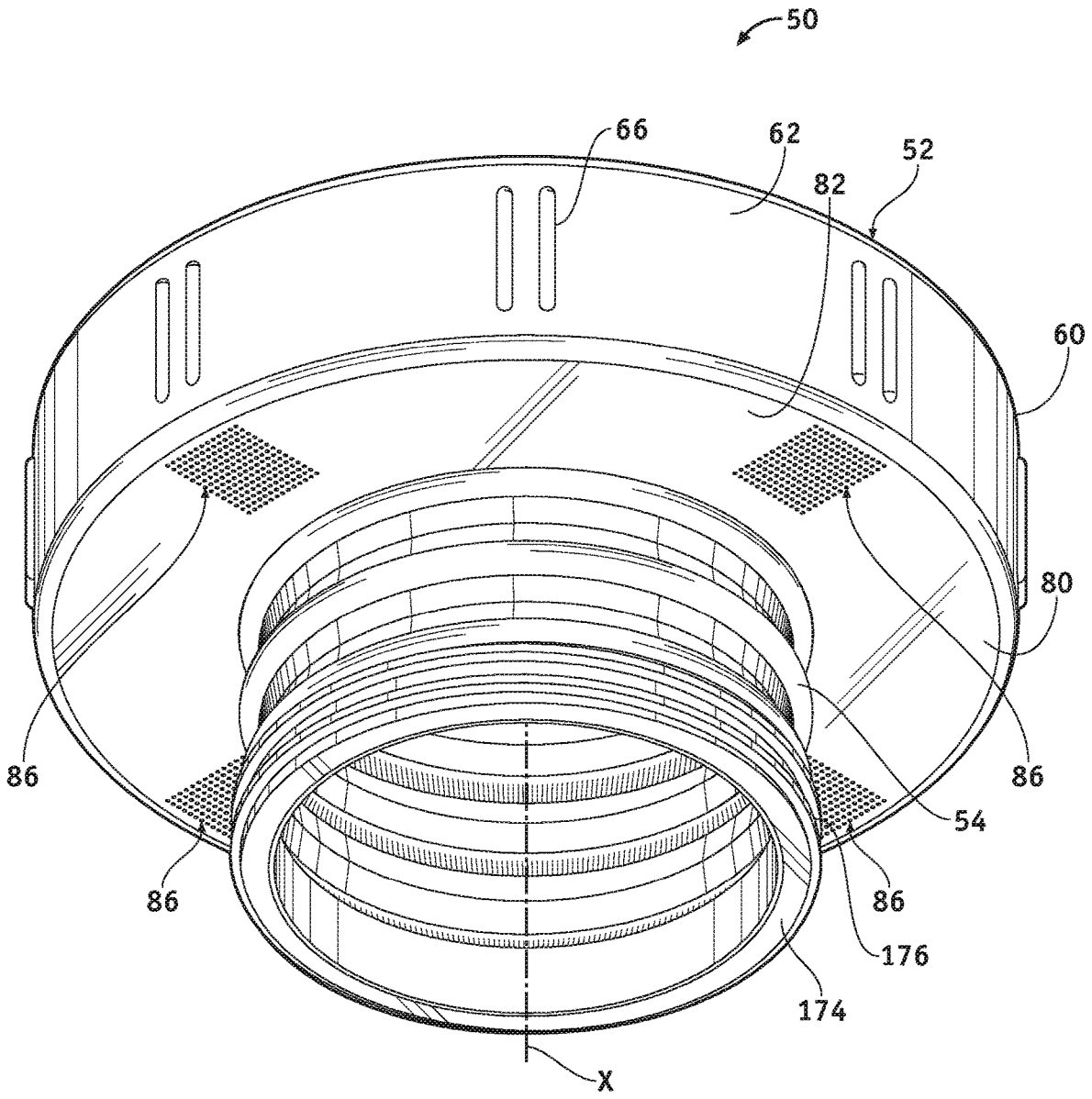
FIG. 2 is a bottom perspective view of the embodiment of FIG. 1.
Figure 6:
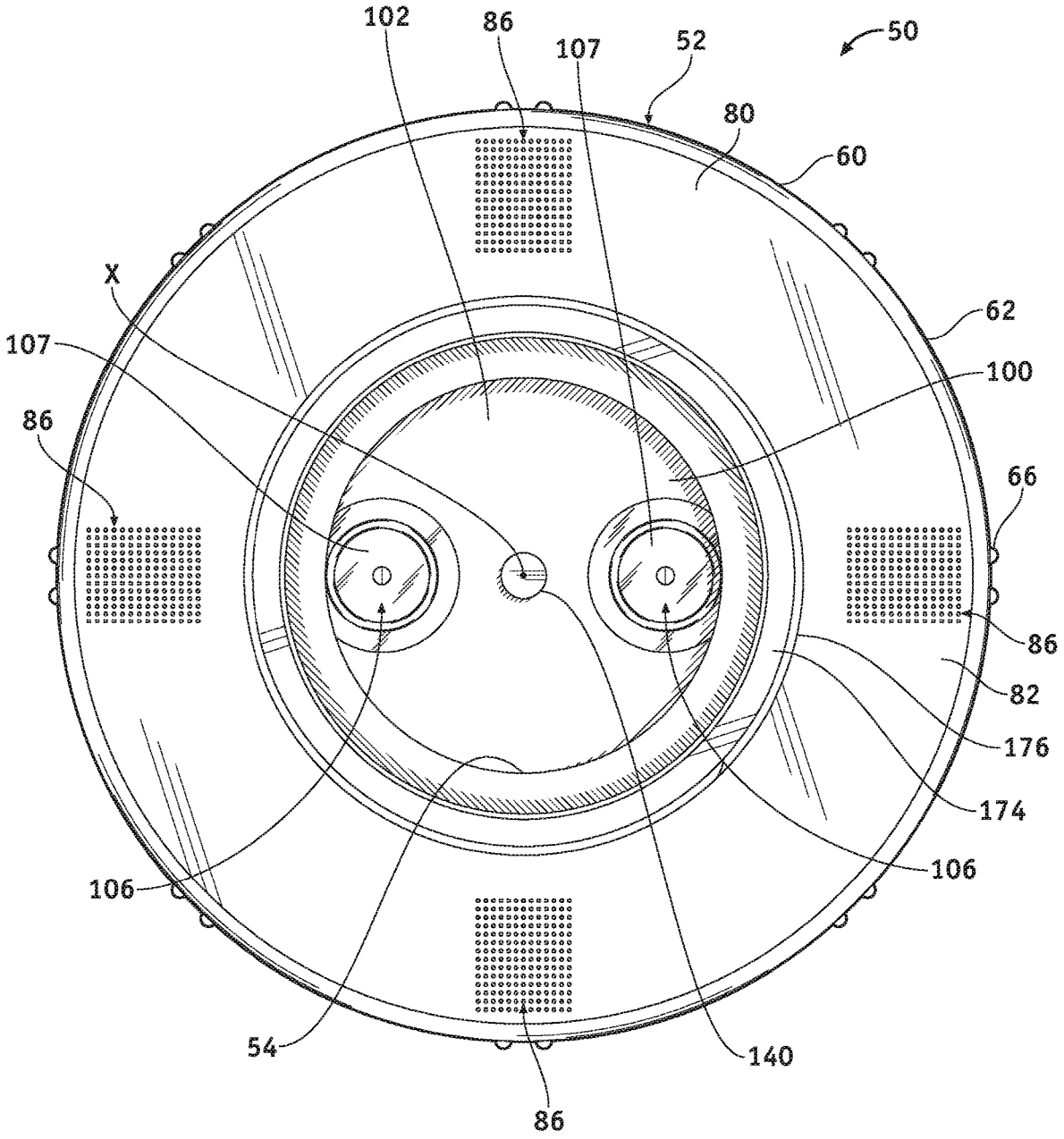
FIG. 6 is a bottom plan view of the embodiment of FIG. 1.

Referring to FIGS. 1-6 relevantly, the housing 52, a hollow construction arranged about axis X and made of an inherently fluid impervious material or combination of materials, such as plastic, metal, or other material, or a combination of fluid impervious materials with inherently resilient and rigid material characteristics, includes a continuous outer sidewall 60 extending upright between a horizontal, annular upper or top flange 70 at the top of the housing 52 and a horizontal, annular lower or bottom wall 80 at the bottom of the housing 52. The outer sidewall 60 is cylindrical and has an outer surface 62 and an inner surface 64. The outer surface 72 has finger holds 66, providing a secure and comfortable grip for fingers, allowing a user to hold and turn the housing 52. In this example, the finger holds 66 are raised ribs spaced apart circumferentially. The top flange 70, a projecting annular or radial rim, has a radial outer surface 72, a radial inner surface 74, and projects radially inward toward axis X from the outer sidewall 60 to an annular edge 76 encircling a central opening 78 into the housing 52 in FIG. 3 that is closed by a closure 120 discussed below. The bottom wall 80 is under and parallel to the top flange 70 and includes a radial outer surface 82, a radial inner surface 84, and vents 86, the outer vents of the lid assembly's 50 housing 52. The bottom wall 80, a radial bottom wall, extends radially inward toward axis X from the outer sidewall 60 to the housing's 52 continuous inner sidewall 90. In FIGS. 2 and 6, the vents 86 are spaced apart circumferentially along the housing's 52 bottom wall 80 about axis X. In this example, there are four vents 86, and the housing 52 can incorporate less or more of them as desired.

Figure 3:
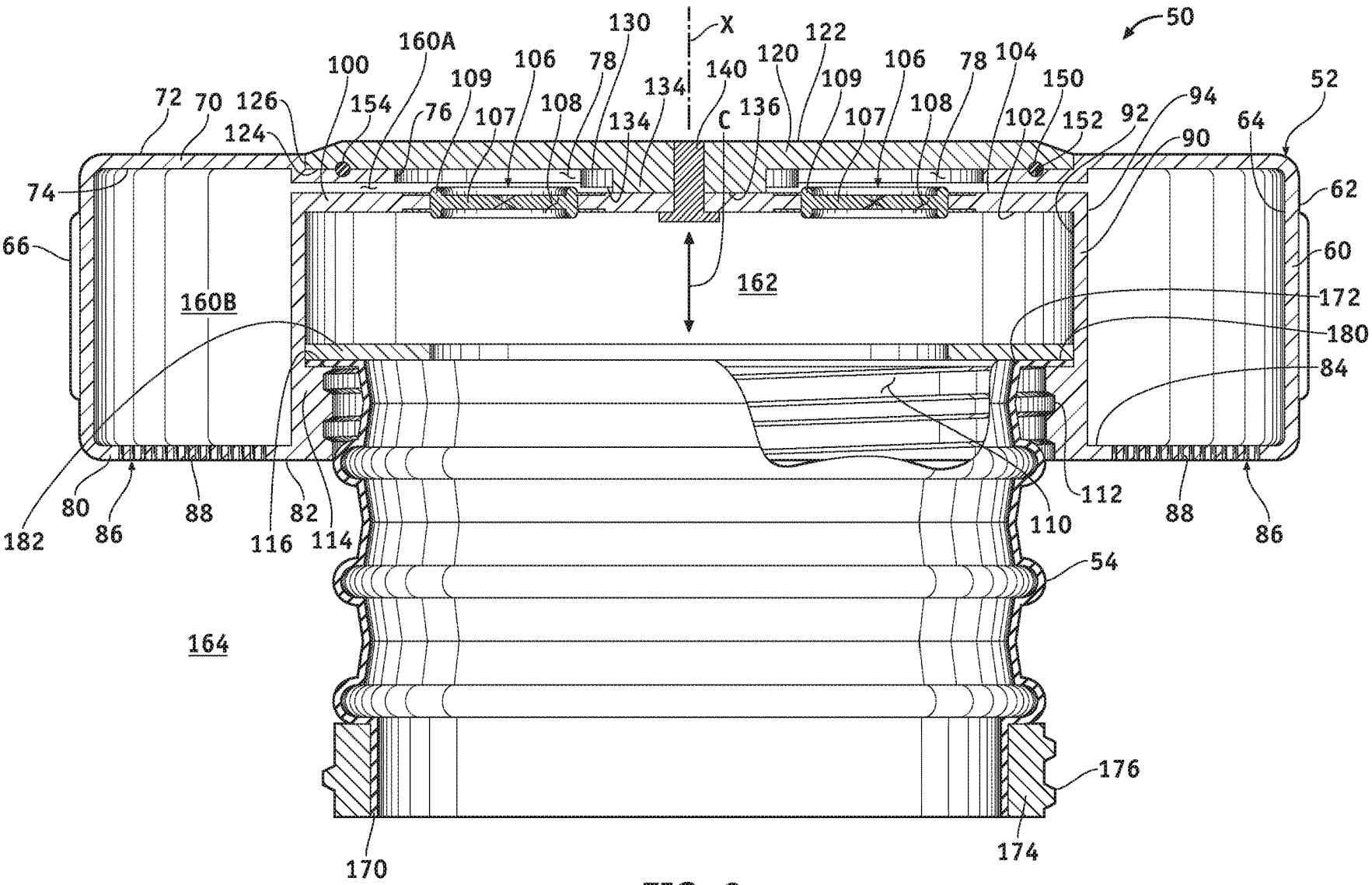
FIG. 3 is a section view taken along line 3-3 of FIG. 1, illustrating the housing's closure, inner vents, outer vents, receiving area, gas flow pathway, and the bellows, the gas flow pathway extending between the inner vents, allowing gas transfer between the receiving area and the gas flow pathway, and the outer vents, allowing gas transfer between the gas flow pathway and an atmosphere, and the bellows including an open distal end open to the receiving area and the inner vents and configured to fit over a container, the bellows shown in an extended position, extended outward of the receiving area to the open distal end, portions of the bellows broken away for illustrative purposes.
Figure 4:
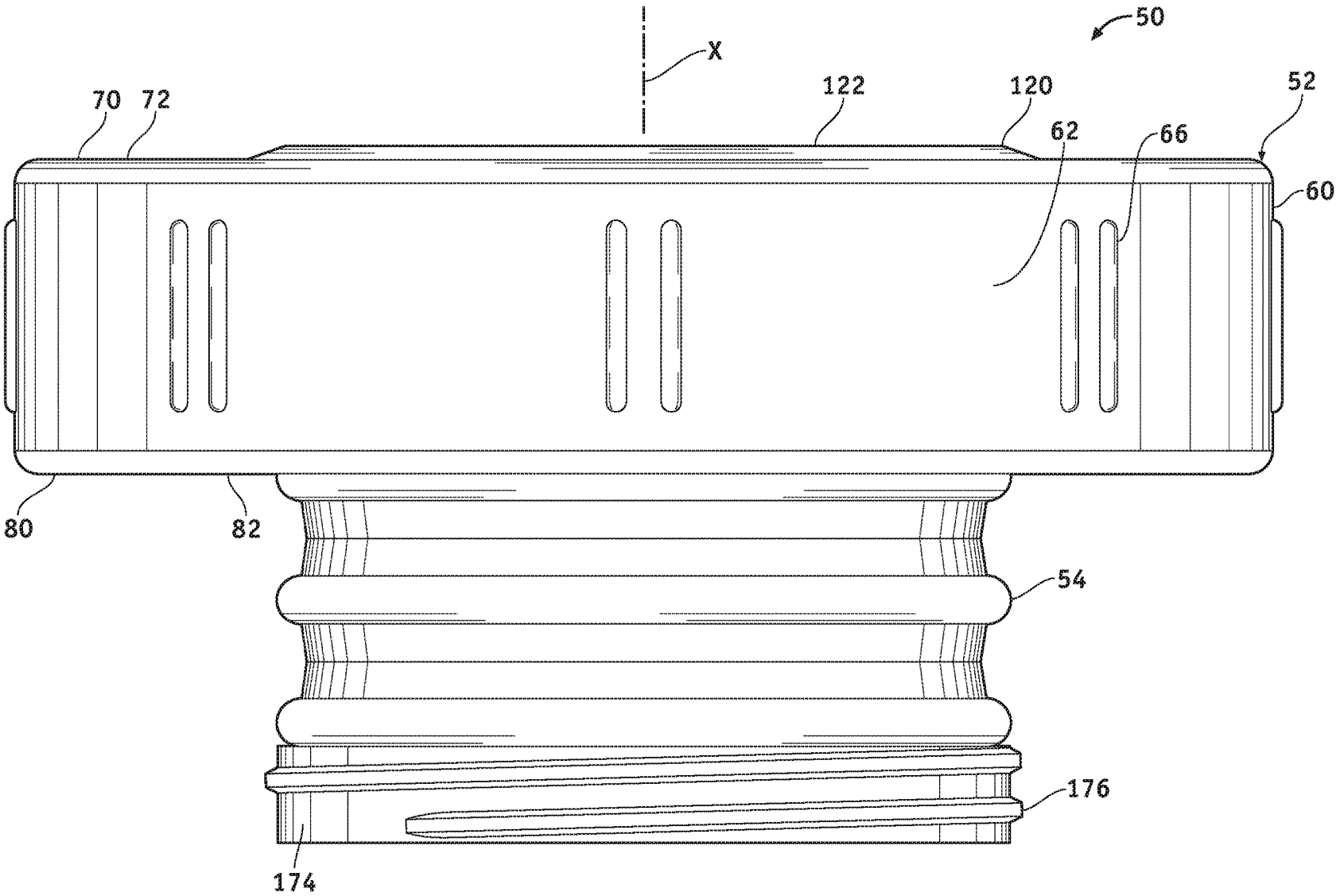
FIG. 4 is a side elevation view of the embodiment of FIG. 1.
Figure 5:
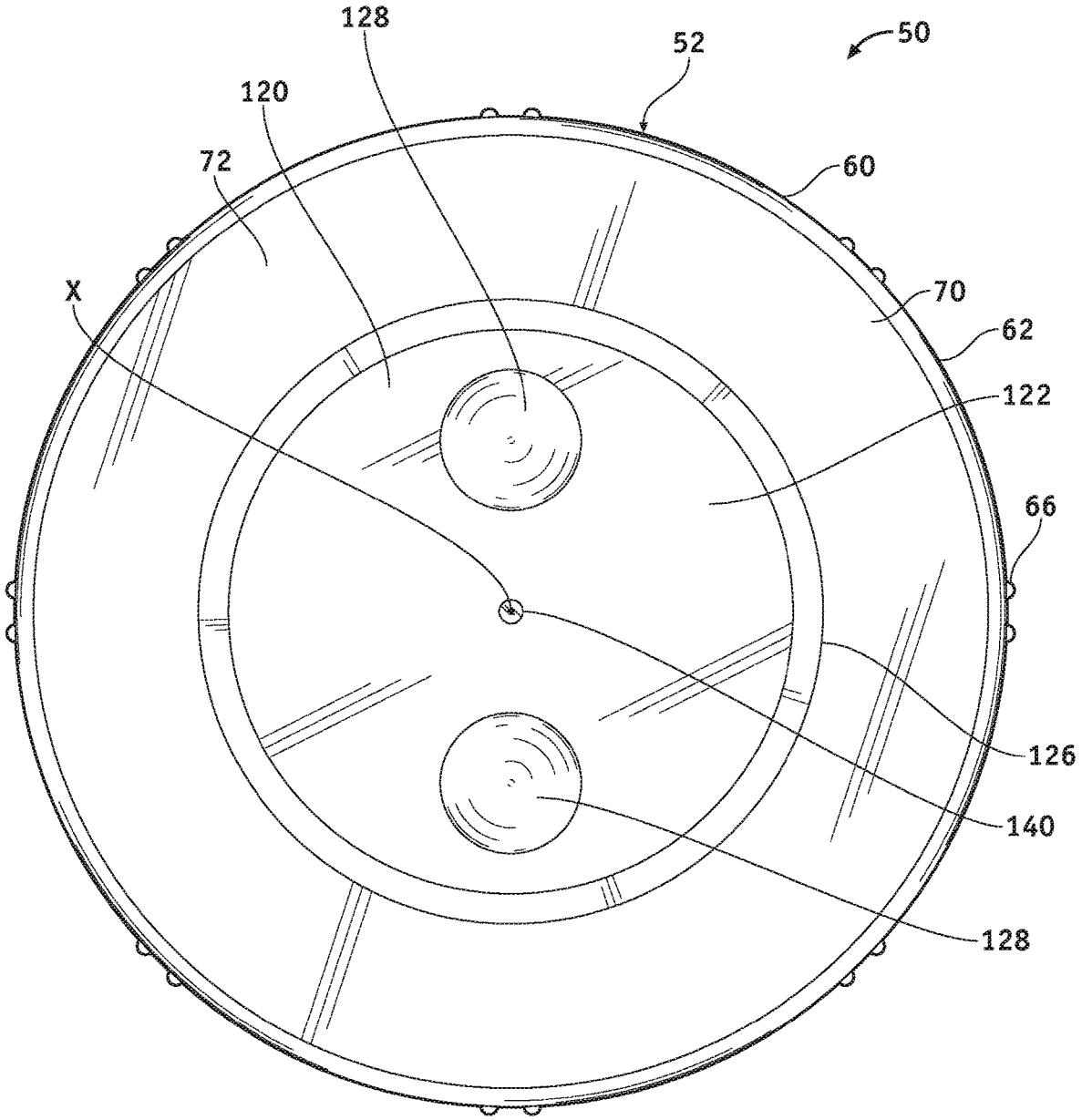
FIG. 5 is a top plan view of the embodiment of FIG. 1.
Figure 7:
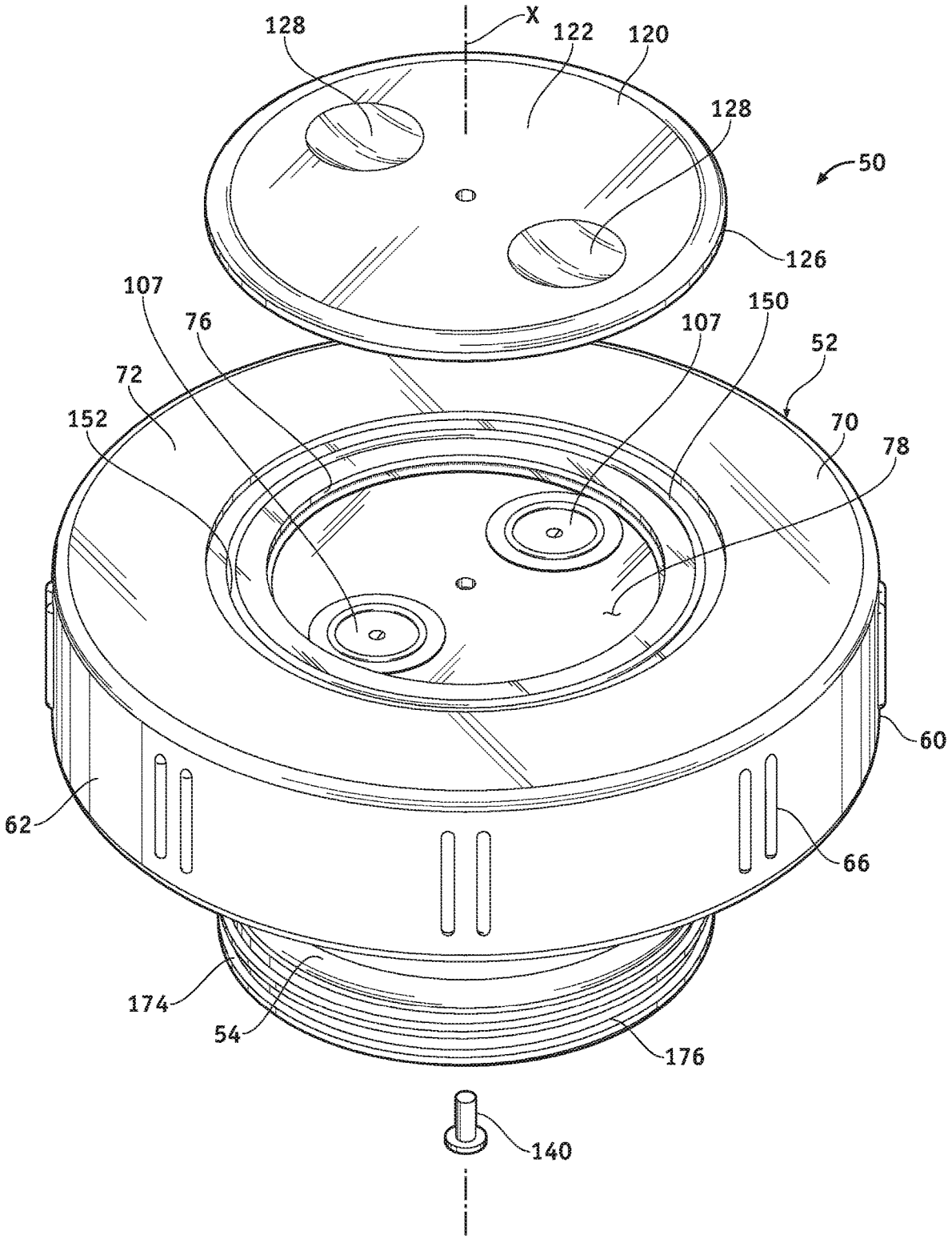
FIG. 7 is a view corresponding to FIG. 1, illustrating the closure separated from the housing revealing the housing's inner vents.

In FIG. 3, the inner sidewall 90 is cylindrical, parallel to the outer sidewall 60, includes an outer surface 92 and an inner surface 94, and extends upright between the bottom wall 80 and a horizontal top wall 100. The outer sidewall 60 and the inner sidewall 90 are concentric, arranged about a common center, namely, axis X. The top wall 100 is parallel to and under the top flange 70 and the opening 78 and includes an outer surface 102, an inner surface 104, and vents 106, the inner vents of the lid assembly's 50 housing 52. In FIGS. 3, 6 and 7, the vents 106 are spaced apart circumferentially along the housing's 52 top wall 100 about axis X, each of the vents 106 being between the inner sidewall and axis X about which the housing 52 is arranged. In this example, there are two vents 106, and the housing 52 can incorporate less or more of them as desired.

The inner sidewall 90 defines a hole 110. The hole 110, a threaded hole, includes an internal thread 112 formed in an annular collar 114 of the inner sidewall 90. The collar 114 extends radially inward from the inner sidewall's 90 outer surface 92 to the internal thread 112 and upright from the bottom flange 80 to an annular seat or step 116. The step 116 is under the top wall 100 and extends radially inward from the outer surface 92 to the internal thread 112.

Figure 8:
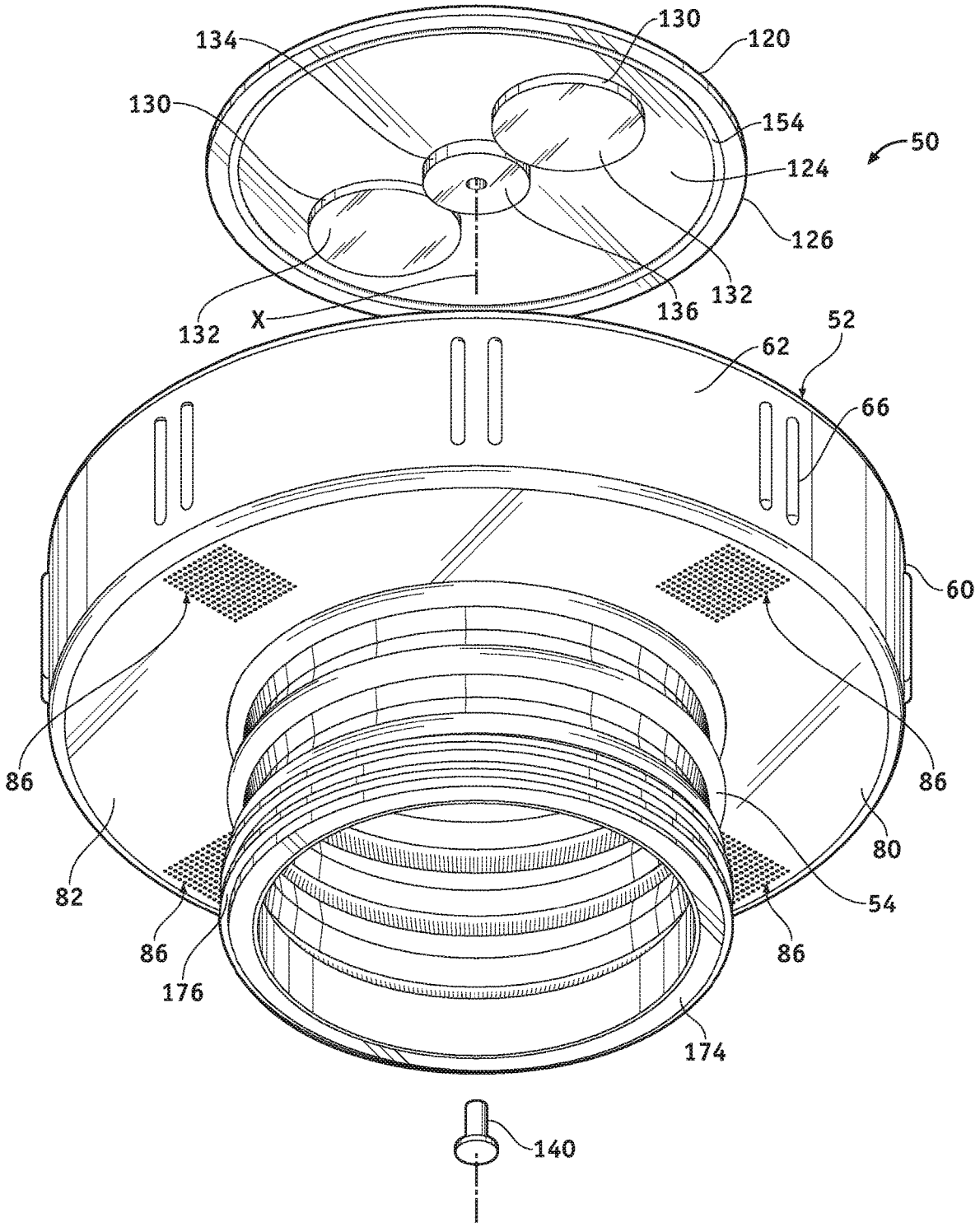
FIG. 8 is a view corresponding to FIG. 2, illustrating the closure separated from the housing revealing the closure's profiles.

The housing 52 has a closure 120 arranged and mounted to the housing 52 rotatably about axis X and configured to open and close the housing's 52 vents 106. The closure 120 at the top of the housing 52 is parallel to the top wall 100 and spans and closes the opening 78 over the top wall 100. Regarding FIGS. 3, 7, and 8 relevantly, the closure 120 is a disk, a circular plate, that has an upper or outer surface 122 facing outward from the housing 52, a lower or inner surface 124 facing inward into the housing 52 over and closing the opening 78, a perimetric edge 126, and opposed finger holds 128 formed in the outer surface 122. In FIG. 8, identical profiles 130 on either side of a central lug 134 project downward from the disk's 120 inner surface 124 to respective engagement surfaces 132. The engagement surfaces 132 are coplanar. The lug 134, arranged about axis X, projects downward from the disk's 120 inner surface 124 to and beyond the engagement surfaces 132 to an engagement surface 136 directly against the top wall's 100 inner surface 104 centrally between the vents 106 in FIG. 3. The closure 120 extends radially outward from a central pivot pin 140 to and beyond the top flange's 70 annular edge 76 and over the top flange's 70 outer surface 72 to the closure's 120 perimetric edge 126. The pivot pin 140, arranged about axis X at the geometric center of the lid assembly 50, connects the closure's 120 lug 134 to the top wall 100 rotationally, creating a pivot point or hinge allowing the closure 120 to turn or otherwise rotate about axis X in opposite directions indicated by double arrow A in FIG. 1. Other suitable methods of mounting the closure 120 to the housing 52 rotatably can be used in alternate embodiments. The closure's 120 inner surface 124 that closes the housing's opening 78 extends radially outward from the lug 134 to and beyond the top flange's 70 annular edge 76 overlapping the top flange's 70 outer surface 72 to the closure's 120 perimetric edge 126, closing the opening 78. An annular gasket 150 held by and between an annular groove 152 in the outer surface 72 of the top flange 70 inboard of its annular edge 76 and a corresponding annular groove 154 in the inner surface 124 of the closure 120 inboard of its annular edge 126 create a seal to prevent leakage between the top flange's 70 outer surface 72 and the closure's 120 inner surface 124 overlapping the top wall's 70 outer surface 72. In this example, the gasket 150, a mechanical seal, is a standard O-ring of rubber or other deformable material. The provision of the seal 150 does not disable the closure 120 from being rotated. The profiles 130 relate spatially to the top wall's 100 respective vents 106, allowing the profiles 130 to move into and out of closed positions concurrently closing the respective vents 106 in response to rotation of the closure 120, whether in the same direction or opposite directions. Rotation of the closure 120 does not open the opening 78, constantly closed by the closure 120, or form, whether permanently or temporarily, another opening into the housing 52. The finger holds 128, indentations in the closure's 120 outer surface 122, provide a secure and comfortable grip for fingers, allowing a user to turn or otherwise rotate the closure 120 in response to applying an amount of force sufficient to displace the closure 120 rotationally.

In FIG. 3, the housing 52 defines a gas flow pathway 160 and a receiving area 162 for the bellows 54. The gas flow pathway 160, a volume within the housing 52, extends from the vents 106 to the vents 86. The receiving area 162, a pocket configured for the reception of the bellows 54, extends into the housing 52 through the hole 110.

The inner surface 64 of the outer sidewall 60, the inner surface 74 of the top flange 70, the inner surface 84 of the bottom wall 80, the inner surface 94 of the inner sidewall 90, the inner surface 104 of the top wall 100, and the inner surface 124 of the closure 120 define the pathway 160. The outer surface 92 of the inner sidewall 90, the outer surface 102 of the top wall 100, the step 116, and the hole 110 consisting of the internal thread 112 define the receiving area 162. The receiving area 162 extends downward axially from the top wall's 100 outer surface 102 to the opening 110. The receiving area 162 opens outwardly through the opening 110. The housing's 52 vents 106 allow gas transfer between the receiving area 162 and the pathway 160. The housing's 52 vents 86 allow gas transfer between the pathway 160 and an atmosphere 164 external of the lid assembly 50. The pathway 160 allows gas transfer between the vents 106, the inner vents of the lid assembly 50, and the vents 86, the outer vents of the lid assembly 50.

The pathway 160 includes a radial component 160A and a circumferential component 160B. The radial component 160A extends radially outward at the top of the housing 52 over the receiving area 162 from the lug 134 and the vents 106 to the circumferential component 160B, extending downward from the radial component 160A to the vents 86. The circumferential component 160B circumscribes the receiving area 162. The inner surface 104 of the top wall 100, the inner surface 74 of the top flange 70 over the inner surface 104 of the top wall 100, and the closure's 120 inner surface 124 over the top wall's 100 inner surface 104 define the radial component 160A. The inner surface 64 of the outer sidewall 60, the inner surface 94 of inner sidewall 90, the inner surface 84 of the bottom wall 80, and the inner surface 74 of the top flange 70 over the inner surface 84 of the bottom wall 80 define the circumferential component 160B. The vents 106 allow gas transfer between the receiving area 162 and the radial component 160A. The vents 86 allow gas transfer between the circumferential component 160B and the atmosphere 164.

In this example, each vent 86 is a cluster of openings 88 extending through the bottom wall 80 from its inner surface 84 to its outer surface 82. Each vent 106 is, in turn, an elastomeric pressure relief valve 107, a standard two-way valve occupying an opening 108 extending through the housing's 52 top wall 100 from the outer surface 102 to the inner surface 104, each valve 107 fitted or molded onto the top wall 100 and extending radially inward through the opening 108 it occupies from an annular or parametric rim 109 extending downward from the top wall's 100 outer surface 102 and upward from the top wall's 100 inner surface 104.

The housing 52 extends radially outward from the bellows 54 applied to the receiving area 162 to the housing's 52 outer sidewall 60. In FIG. 3, the bellows 54 coupled to the housing 52 is a tubular, flexible and foldable concertina-type bellows made of an elastomer, an elastic and inherently fluid-impervious substance occurring naturally, as natural rubber, or produced synthetically, as silicone or the like. The bellows 54 is open to the receiving area 162 and the vents 106 and opens an open container and its contents to the receiving area 162 and the vents 106 when the bellows 54 is connected to the open container.

The bellows 54, arranged about axis X and is concentric with the housing's outer and inner sidewalls 60 and 90, extends axially upright from an open lower or distal end 170 to the receiving area 162 through the hole 110 and beyond the collar's 114 step 116 to an open upper or proximal end 172. The cylindrical open distal end 170, configured to fit over a container, and the cylindrical open proximal end 172 are concurrently open to the receiving area 162 and the vents 106.

An annular collar 174 of plastic or metal, having an external thread 176 configured to thread onto the housing's 52 internal thread 112, receives and circumscribes the open distal end 170. Contact cement or adhesive seals the collar 174 externally to the open distal end 170. The collar 174 secured to the open distal end 170 exteriorly is part of the open distal end 170. The open proximal end 172 is outturned, forming a flange 180, projecting radially outward over the step 116 between the step 116 and the top wall's 100 outer surface 102 to the inner sidewall's 90 outer surface 92. Atop the flange 180, between it and the top wall's 100 outer surface 102, is a gasket 182. The gasket 182, a mechanical seal in the form of a flat ring, is a standard reinforced rubber gasket made from rubber sheet material with one or more plies of fabric inserted in the rubber to impart strength and stability. The gasket 182 secures the flange 180 and extends entirely over the flange 180 positioned over the step 116, stopping the open proximal end 172 from withdrawing outwardly inadvertently from the receiving area 162 through the hole 110. Contact cement or adhesive seals the gasket 182 to the flange 180. The gasket 182 is part of the open proximal end 172.

The housing 52 is free to rotate about the bellows 54, about the open proximal end 172 of the bellows 54, in opposite directions indicated by double arrow B in FIG. 1 about axis X, the housing 52 and the bellows 54 thereby being configured for relative rotation. Axis X is the axis of rotation of the housing 52 and the closure 120. The open proximal end 172 of the bellows 54 is, in turn, free to reciprocate through the receiving area 162 along the inner sidewall's 90 outer surface 92 in opposite directions coincident with axis X and indicated by double arrow C in FIG. 3 between the step 116 and the outer surface 102 of the top wall 100 and the top wall's 100 vents 106, the housing 52 and the bellows 54 thereby being configured for relative reciprocal movement in opposite directions indicated by arrow C coincident with axis X.

Figure 12:
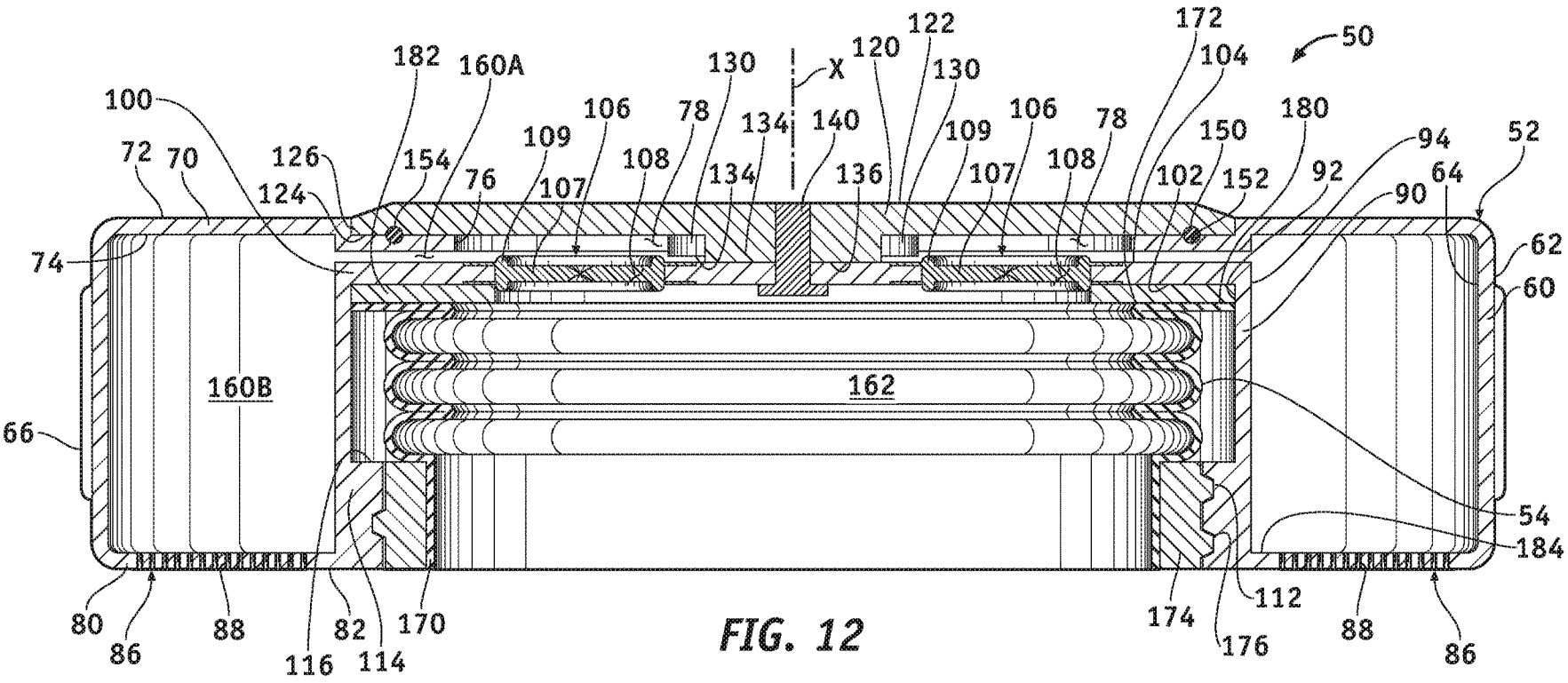
FIG. 12 is a section view corresponding to FIG. 3, illustrating the bellows in a collapsed position, compressed in the receiving area between the inner vents and the open distal end, and the closure in its open position corresponding to FIG. 9.
Figure 13:
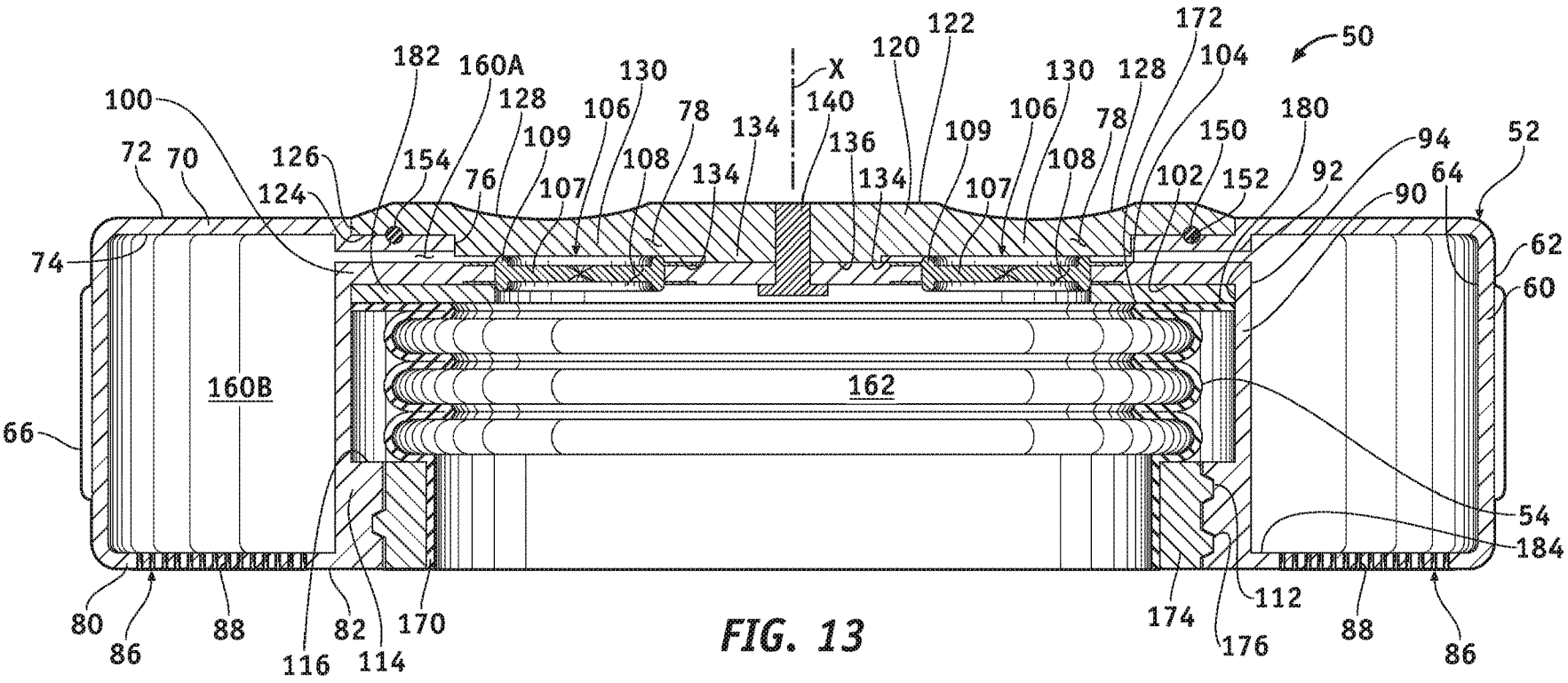
FIG. 13 is a section view like FIG. 12, illustrating the bellows in the collapsed position, compressed in the receiving area between the inner vents and the open distal end, and the closure in its closed position corresponding to FIG. 10.

The bellows 54 is adjustable axially relative to the housing 52 between an extended position in FIGS. 1-4, 7, 8, and 11, and a collapsed position in FIGS. 12 and 13. In its extended position in FIGS. 1-4, 7, 8, and 11, the bellows 54 extends downward from the housing's 52 bottom wall 80 to the open distal end 170, extended, as shown in FIGS. 3 and 12, outward of the receiving area 162, from the flange 180 atop the step 116 and the open proximal end 172, through and beyond the hole 110 to the open distal end 170 configured to fit over a container. Since the bellows 53 is made of an elastic material, it has an inherent shape-memory material characteristic, automatically assuming its extended position at rest and constantly tensioned toward its extended position when compressed to its collapsed position. In its collapsed position in FIGS. 12 and 13, the bellows 54 is compressed in the receiving area 162 between the vents 162 and the open distal end 170, between the flange's 180 gasket 182 in direct contact against the outer surface 102 of the housing's 52 top wall 100 circumferentially outboard of the housing's 52 vents 106 and the open proximal end 170 secured to the housing's 52 hole 110 by the collar's 174 external thread 176 threaded onto the housing's 52 internal thread 112 produced by rotating the internal thread 112 over the external thread 176 or rotating the external thread 176 onto the internal thread 112, securing the bellows in the collapsed position. The housing 52 surrounds the bellows 54, extending radially outward from the bellows 54 to the outer sidewall 60, and encloses the bellows 54 in the receiving area 162 between the hole 100 top wall's 100 outer surface 102 and its vents 106, when the bellows 54 is in its collapsed position compressed in the receiving area 162.

Figure 9:
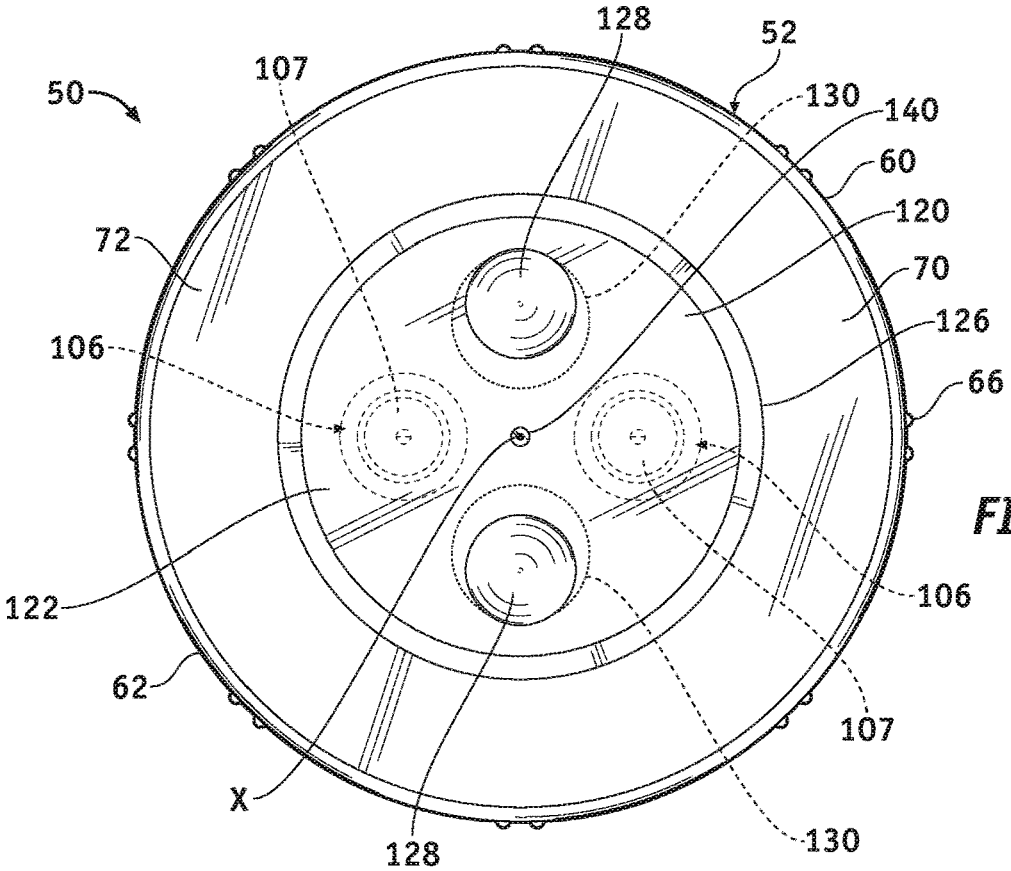
FIG. 9 is a partly schematic top plan view of the embodiment of FIG. 1, illustrating the closure in an open position corresponding to FIG. 3, the closure's FIG. 8 profiles, appearing in phantom line, shown spaced apart circumferentially from the housing's FIG. 7 inner vents, appearing in phantom line, opening the housing's inner vents.
Figure 10:
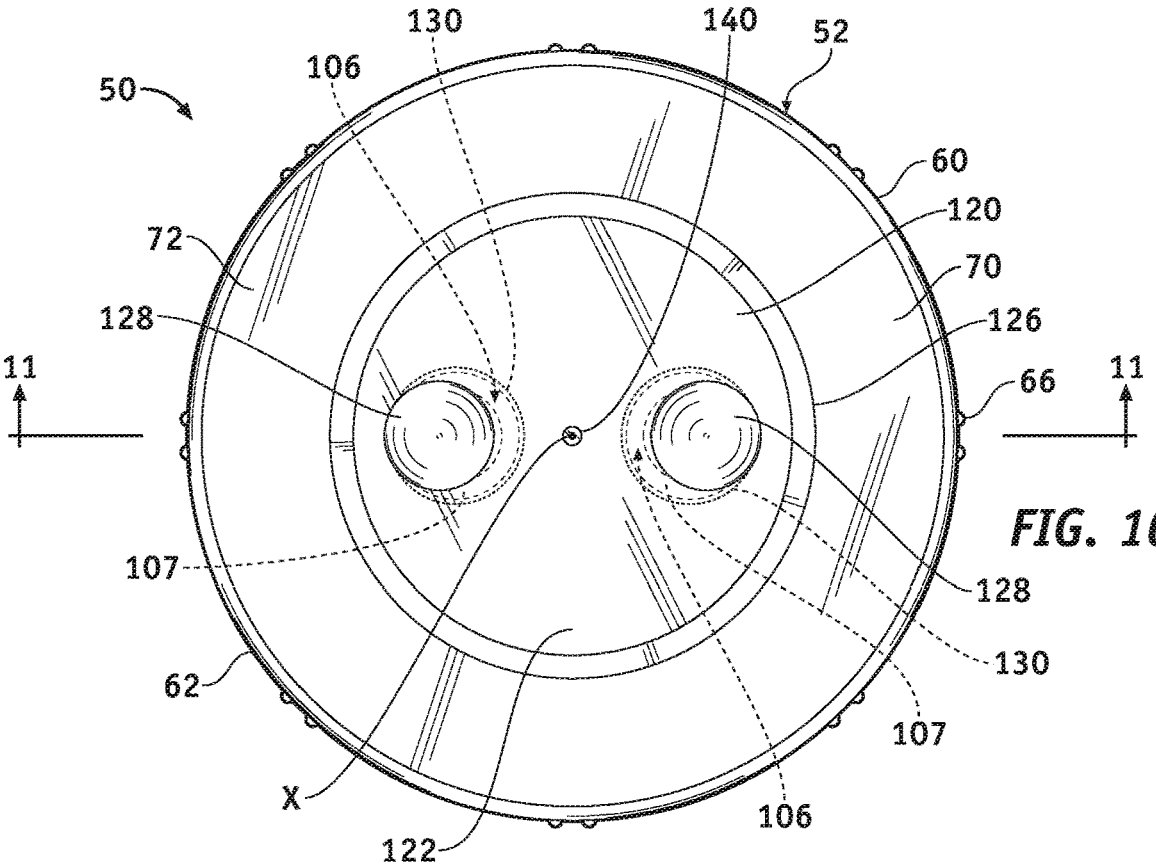
FIG. 10 is a view similar to FIG. 9, illustrating the closure in a closed position, the closure's FIG. 8 profiles, appearing in phantom line, shown applied to the housing's FIG. 7 inner vents, appearing in phantom line, closing the housing's inner vents.
Figure 11:
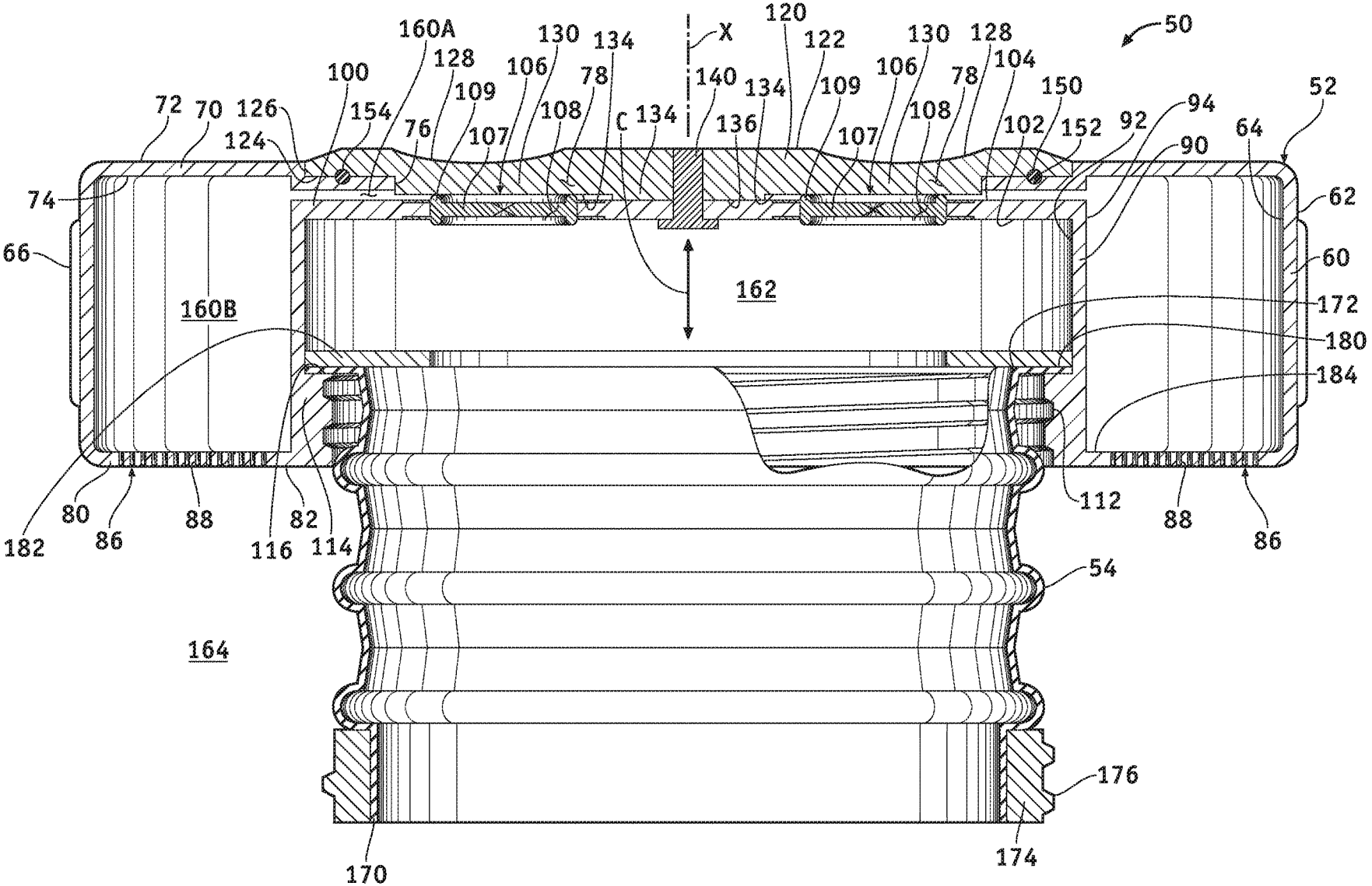
FIG. 11 is a section view taken along line 11-11 of FIG. 10.

When the closure 120 is rotated out of its closed position in FIG. 9, the profiles 130 that relate spatially to the top wall's 100 respective vents 106 are spaced apart circumferentially away from the respective vents 106, concurrently opening the vents 106 allowing gas transfer therethrough between the receiving area 162 and the pathway 160 in FIGS. 3 and 12. When the closure 120 is rotated into its closed position in FIG. 10, the profiles 130 are over and coaxial with the respective vents 106 and their engagement surfaces 132 slide over and directly engage the rims 109 of the respective valves 107 projecting upward from the top wall's 100 inner surface 104 sealingly in FIG. 13, concurrently closing the vents 106 stopping gas transfer therethrough between the receiving area 162 and the pathway 160.

Figure 14:
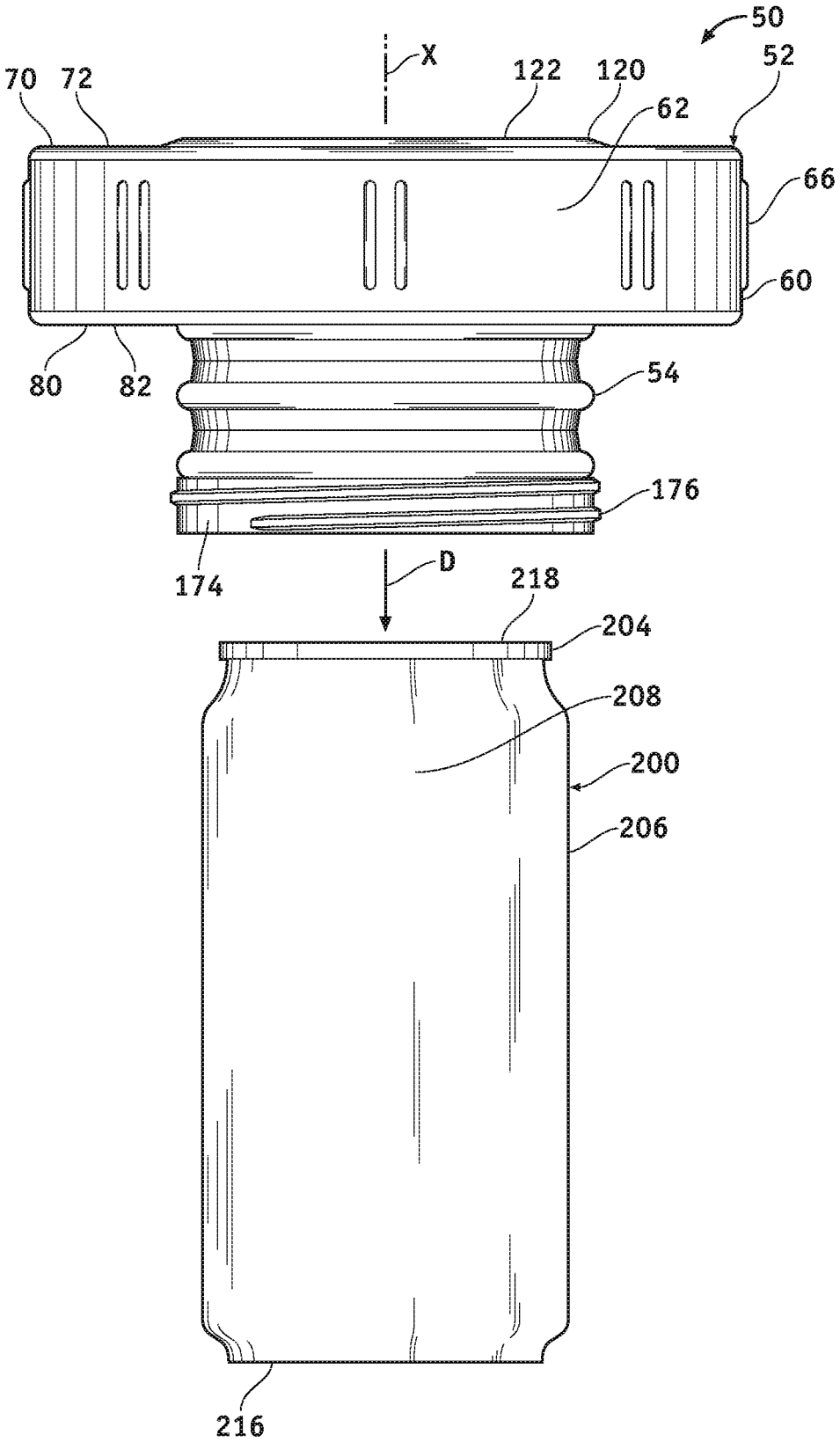
FIGS. 14-20 illustrate closing and developing positive pressure within a container and releasing the positive pressure within the container with the lid assembly of FIG. 1.
Figure 15:
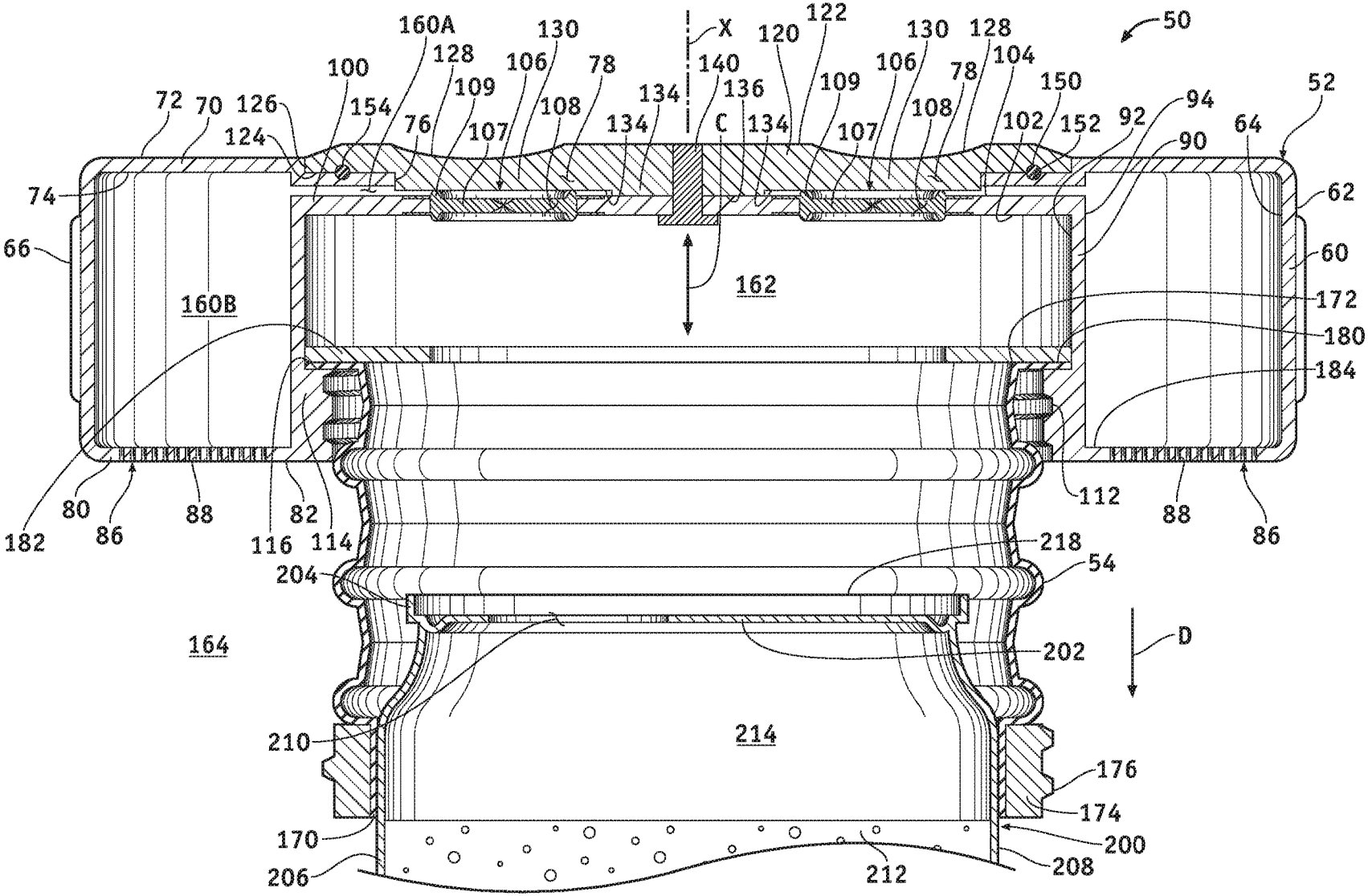

The lid assembly 50 useful for closing an open container and developing positive pressure within the container to preserve the container's contents, such as for retarding the loss of dissolved carbon dioxide from a carbonated beverage in an open container. For example, FIGS. 14 and 15 show a container 200, a standard beverage container, with a lid 202 sealed onto a rim 204 of the container's 200 cylindrical sidewall 206 with an outer, cylindrical surface 208. In FIG. 15, through the lid 202 is an open dispensing opening 210 open to the container's 200 volume 212, allowing the dispensing of the container's 200 contents therethrough from the container's 200 volume 212. In this example, the contents in the container's 200 volume 212 is a carbonated beverage 214. The dispensing opening 210 is formed by a punch or with the aid of a ring tab (not illustrated) that ruptures a portion of the lid 202 about a score line preformed in the lid 202. After producing the opening 210, the pressurized contents of the container 200, a standard, single-serving beverage can in this example, are exposed to atmospheric pressure, permitting the escape of pressurized gases from within the container's 200 volume 212 through the dispensing opening 210. For reference purposes, the container's 200 cylindrical sidewall 206 extends upright from the container's 200 closed bottom 216 to the container's 200 lid 202 at the top 218 of the container 200.

A user uses the lid assembly 50 to close the open container 200 and develop a positive pressure within the container's 200 volume 212. He sets the closure 120 to its closed position, closing the respective inner vents 86, and locates the lid assembly 50 open distal end 170 down over the top 218 of the container 200 in FIG. 14, over the container's 200 lid 202 and its open dispensing opening 210 with the bellows 54 in its extended position extended downward from the housing's 52 bottom wall 80 to the open distal end 170. He moves the lid assembly 50 downward by hand over the top 218 of the container 200, over the container's 200 lid 202, in the direction of arrow D in FIG. 14, and forces by hand the open distal end 170 of the bellows 54 over the top 208 of the container 200 engaging the open distal end 170 of the bellows 54 in direct sealing engagement against and around the container's 200 outer surface 208 below the container's 200 lid 202 in FIG. 15. This mechanically seals the open distal 170 of the bellows 54 to the container's outer surface 208 and opens the container's 200 opening 210 and the contents in the container's 200 volume 212 to the receiving area 162 and the housing's 52 vents 106 via the bellows 54. The circumference of the open distal end 170 of the bellows and the outer surface 208 of the container 200 correspond, enabling the open distal end 170 of the bellows to slide over and engage the container's 200 outer surface 208 sealingly. The user holds the housing 53 by hand and continues to move it downward in the direction of arrow D in FIG. 15, sliding the housing 52 downward in the same direction over the open distal end 172, which translates through the receiving area 162 from the flange 180 atop the step 116 in FIG. 15 to the gasket 182 received directly against the outer surface 102 of the housing's 52 top wall 100 circumferentially outboard of the housing's 52 vents 106 in FIG. 16.

Figure 16:
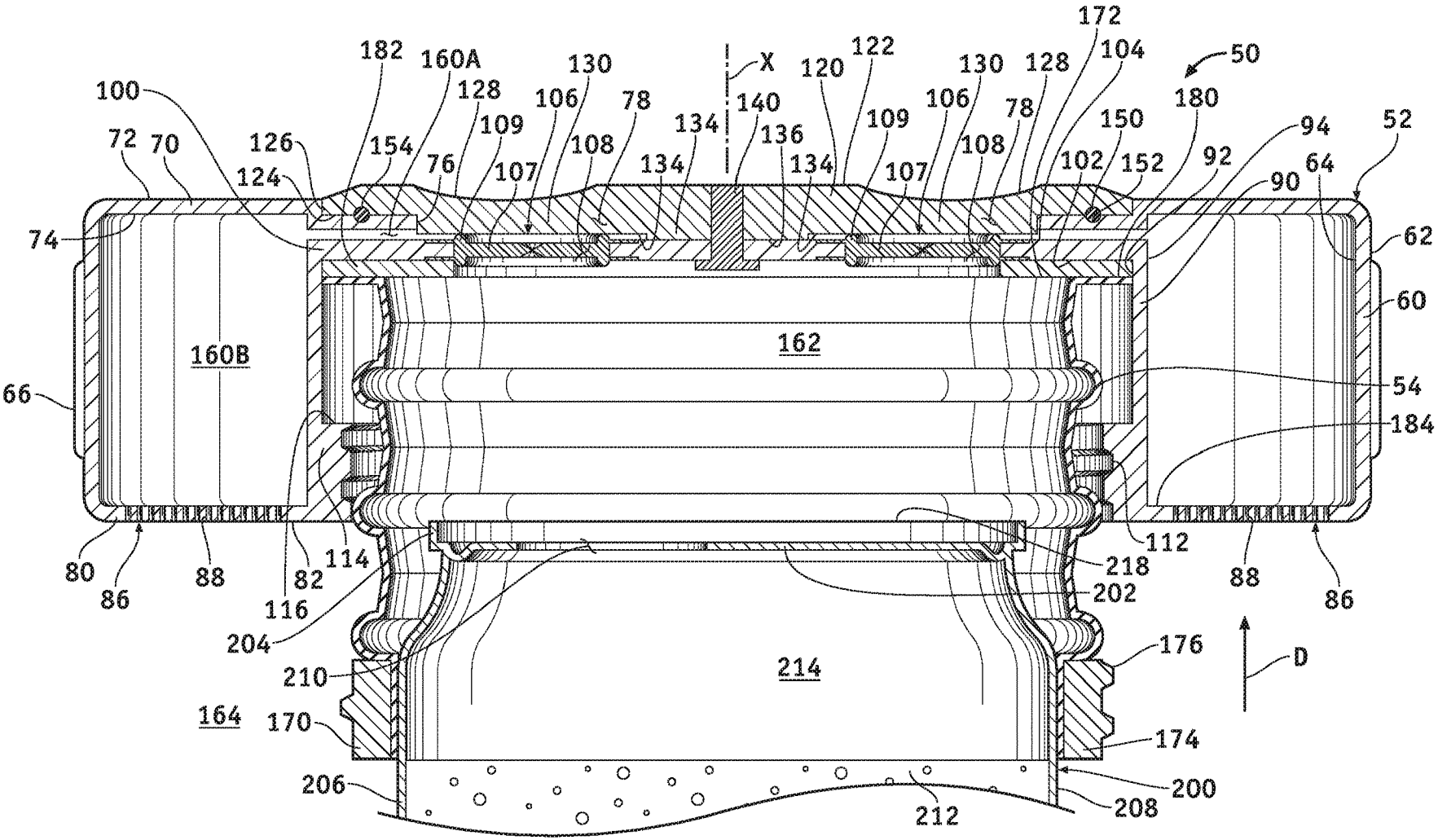
Figure 17:
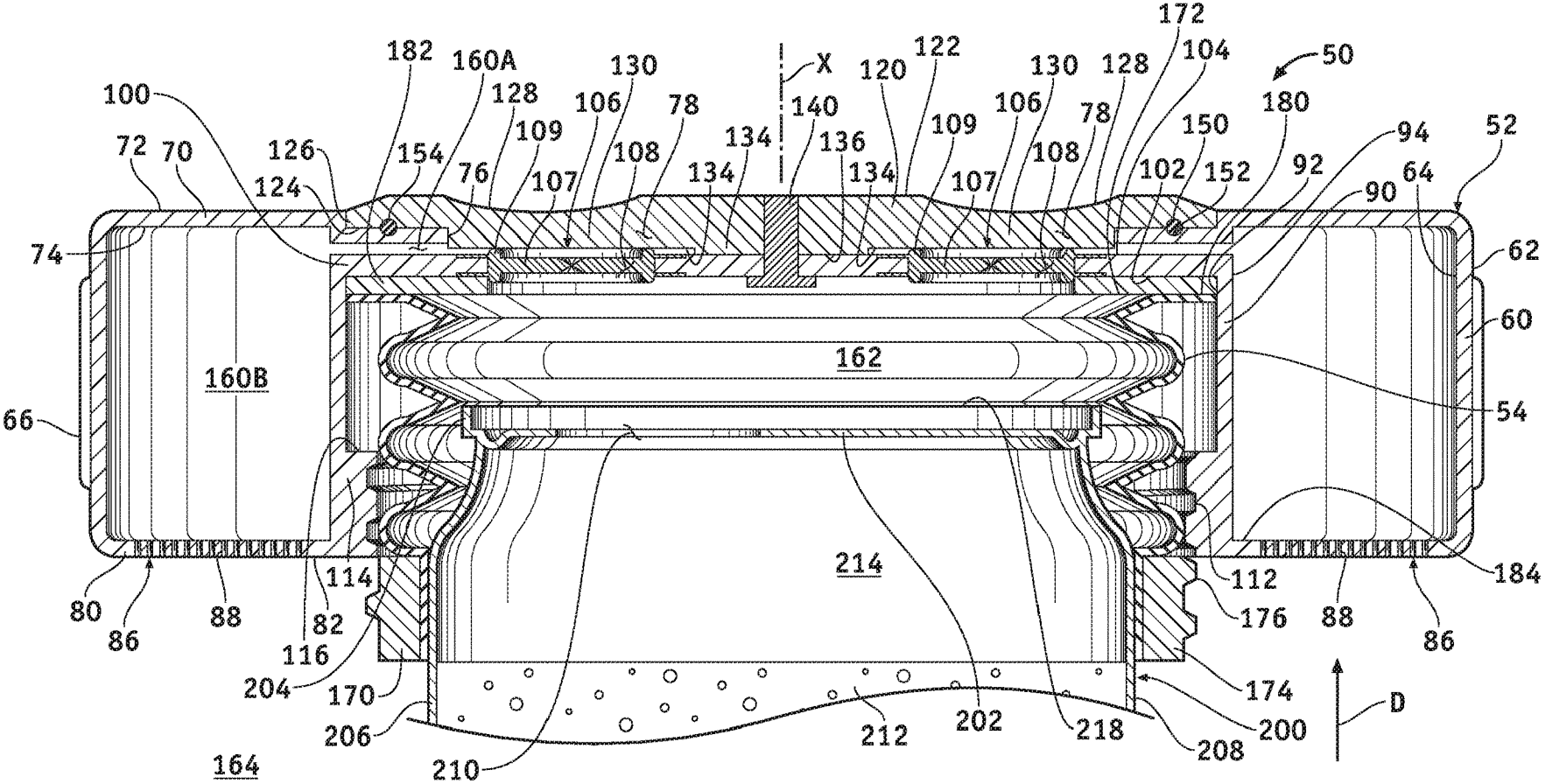
Figure 18:
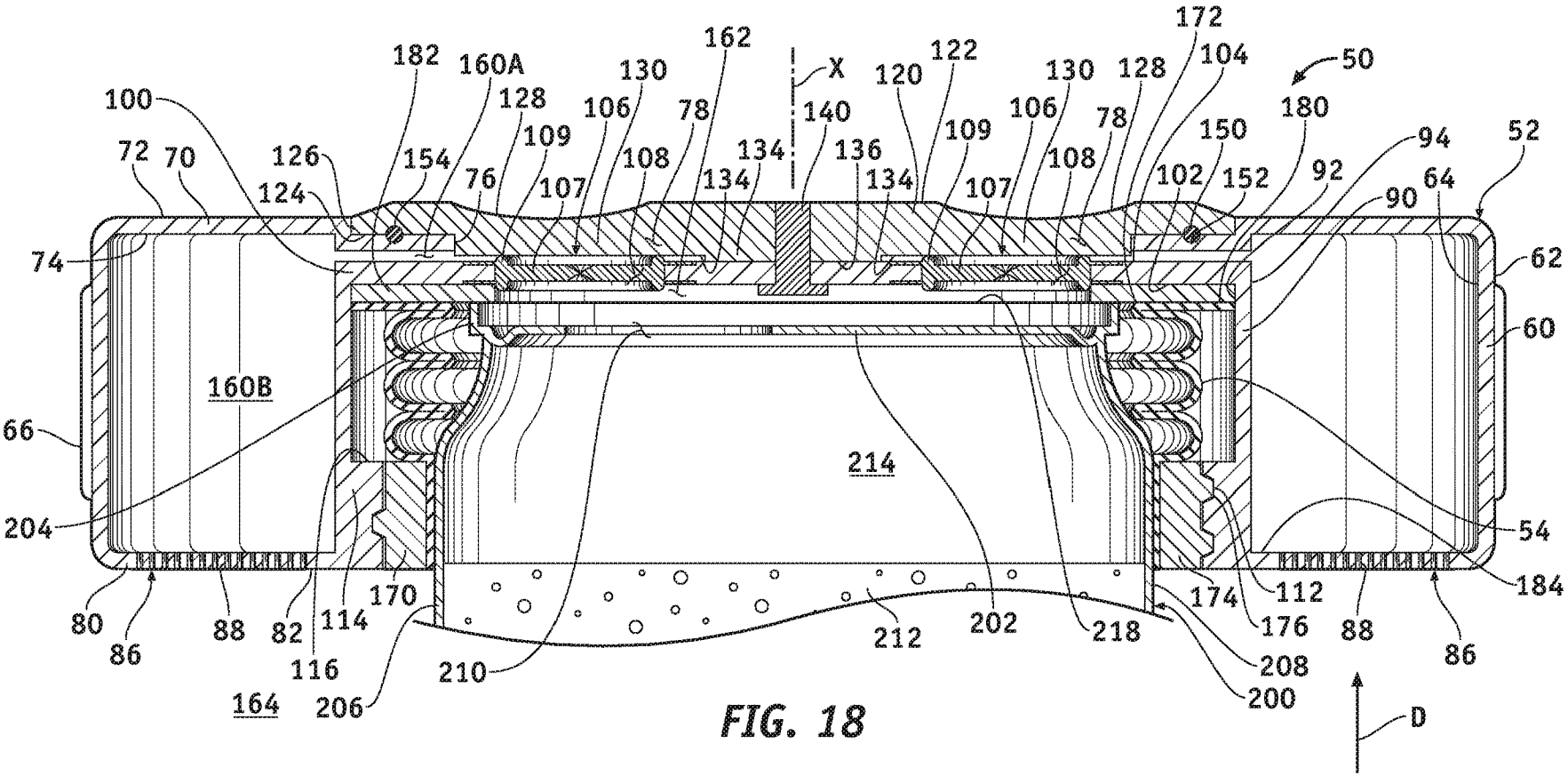

The user continues the downward advancement of the housing 52 in the direction of arrow D in FIG. 16. This collapses and compresses the bellows 54 axially between the gasket 182 directly against the outer surface 102 of the housing's 52 top wall 100 and the open proximal end 170 sealed to the container's 200 outer surface 208 until the external thread 176 initially contacts the housing's 52 internal thread 112 in FIG. 17. The collapsing of the bellows 54 develops a positive pressurization of the container's 200 volume 212 through the container's 200 opening 210 from the receiving area extending downward through the bellows 54 from the outer surface 102 of the top wall 100 and the top wall's 100 closed vents 106 to the container's 200 volume 212. He threads the housing's 52 internal thread 112 on the external thread 176 by inserting the collar 174 into the hole 100 and rotating the housing 52 clockwise in the direction of arrow E in FIG. 1 relative to the bellows 54. This further advances the housing 52 downward in the direction of arrow D in FIG. 17 until, as shown in FIG. 18, the internal thread 112 is threaded over the external thread 176. This further collapses and compresses the bellows 54 axially between the gasket 182 directly against the outer surface 102 of the housing's 52 top wall 100 and the open proximal end 170 sealed to the container's 200 outer surface 208 to the collapsed position of the bellows 54 described in connection with FIGS. 12 and 13. It also further develops the positive pressurization of the container's 200 volume 212 through the container's 200 opening 210 from the receiving area 162 extending downward through the now compressed bellows 54 from the outer surface 102 of the top wall 100 and the top wall's 100 closed vents 106 to the container's 200 volume 212, thereby retarding the loss of the dissolved carbon dioxide from the carbonated beverage 214 in the container's 200 volume 212. The finger holds 66 on the outer surface 62 of the outer sidewall 60 assist the user in gripping the housing 52 by hand during this installation procedure. The user may unthread the housing's 52 internal thread 112 from the external thread 176, releasing the collar 174 and the open distal extremity 170, rotating the housing 52 counterclockwise in the direction of arrow F in FIG. 1 relative to the bellows 54.

Figure 19:
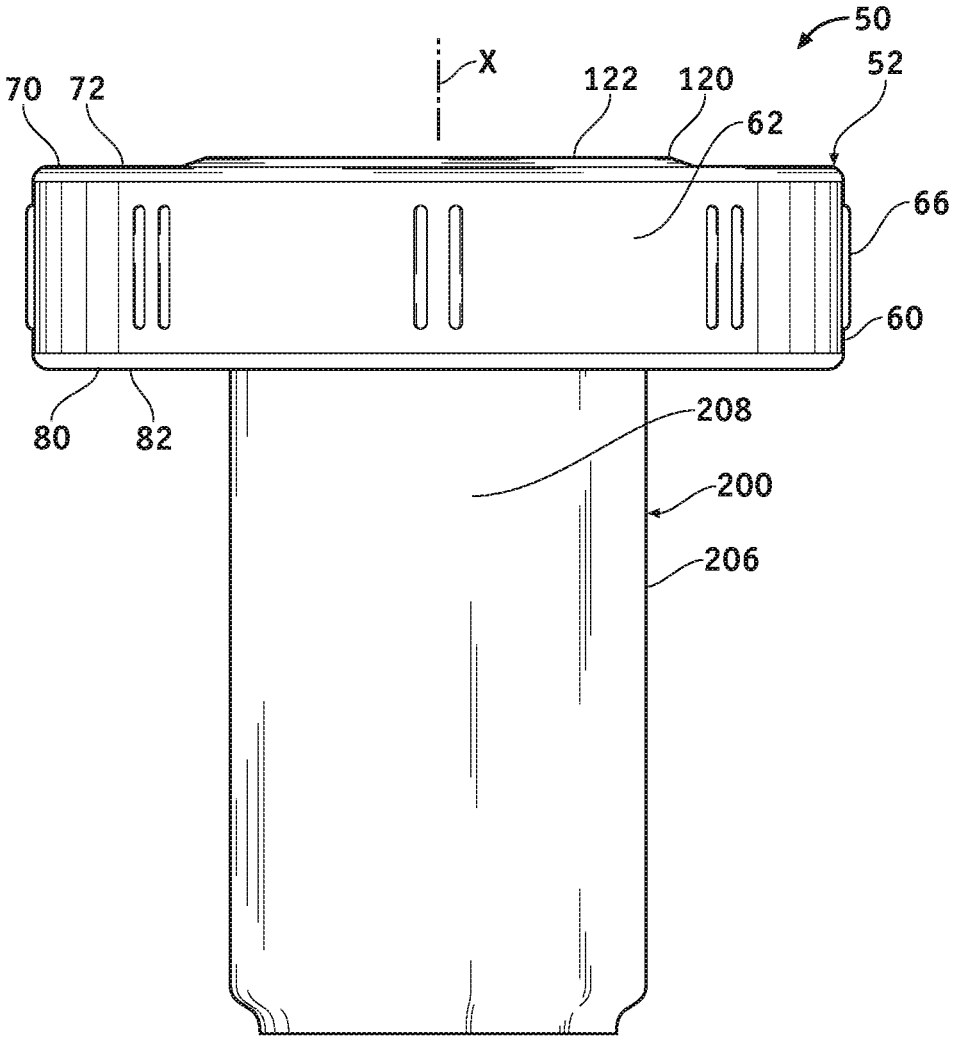

The housing's 52 vents 106 closed by the closure 120 disable gas transfer between the receiving area 162 and the housing's 52 pathway 160. The bellows 54 compressed to its collapsed position is constantly tensioned outwardly to its extended position. This tension across the bellows 54 urges the gasket 182 directly against the outer surface 102 of the housing's 52 top wall 100 circumferentially outboard of the housing's 52 vents 106, mechanically sealing the gasket 182 to the top wall's 100 outer surface 102 to prevent leakage between the gasket 182 and the top wall's 100 outer surface 102. The top wall's outer surface 102 and its closed vents 106, the sealing pressure of the gasket 182 against the wall's top 100 outer surface 102 circumferentially outboard of the closed vents 106 and the sealing pressure of the open proximal end 170 of the bellows against the container's 200 outer surface 208 seals the top 218 of the container 200, its open dispensing opening 210, and the beverage 214 in the container's 200 volume 212, sealing the beverage 214 in the container's 200 volume 212. FIG. 19 shows the container 200 closed and pressurized with the lid assembly 50.

Figure 20:
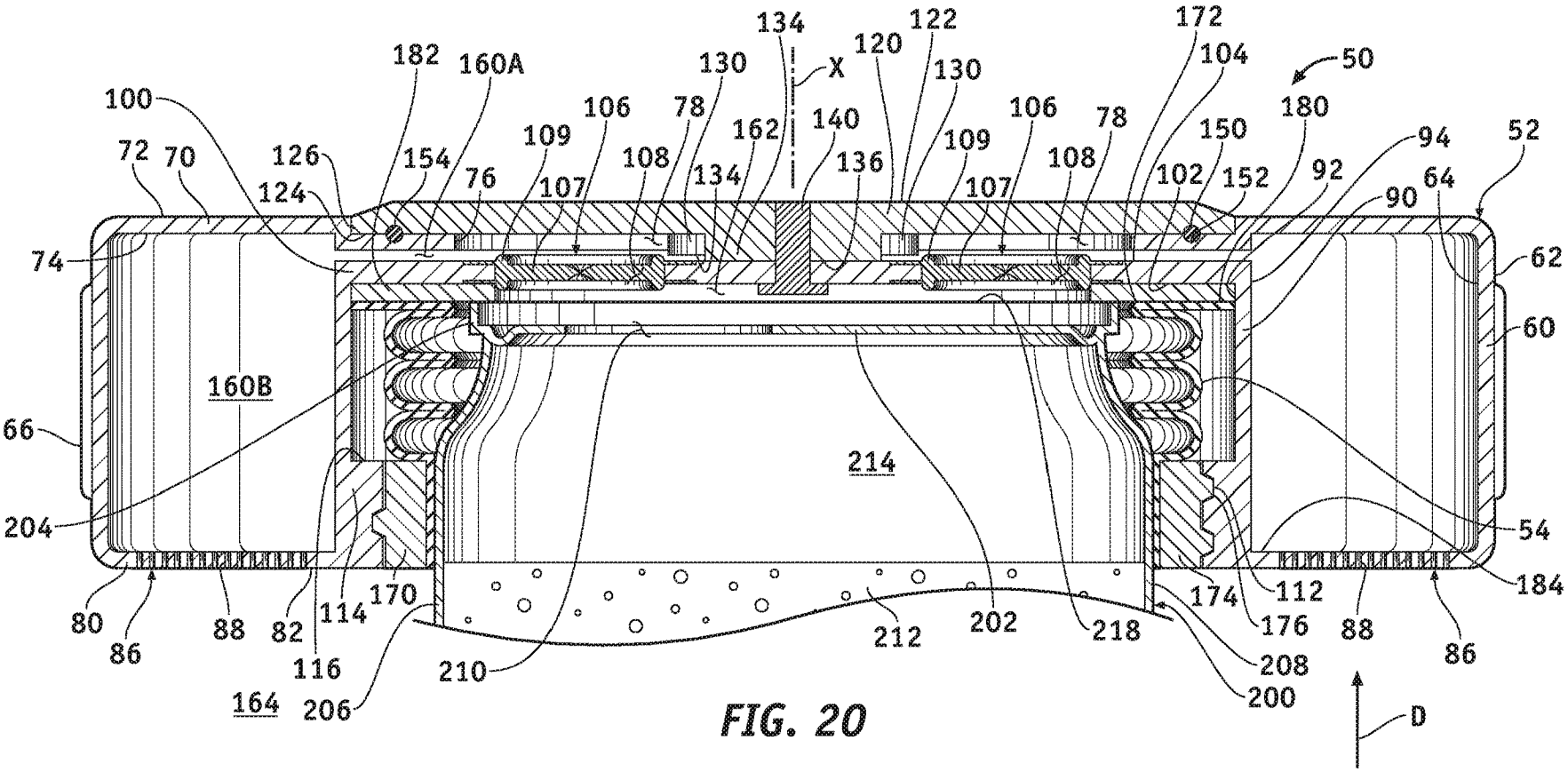

The user withdraws the lid assembly 50 by hand, reversing the described installation operation. Before doing so, he can release pressure within the bellows 54 and the container's 200 volume 214. He can do this by rotating the closure 120 out of its closed position to its open position in FIG. 20, concurrently opening the housing's 52 vents 106. This allows pressurized gas in the receiving area 162 extending through the bellows 54 from the top wall's 100 outer surface 102 to the container's 200 lid 202 and in the container's 200 volume 212 between the lid's 202 dispensing opening 210 and the contents in the container's 200 volume 212, the beverage 214, to overwhelm the internal vents 106 and escape safely therethrough into the pathway's 160 radial component 160A through the internal vents 106, flow radially outward through the pathway's 160 radial component 160A to the pathway's 160 circumferential component 160B, flow downward through the circumferential component 160B from the radial component 160A to the vents 86, and outward through the vents 86 to the atmosphere 164. The lid assembly 50 can be configured and sized for use with any given open container and whatever contents are in it.

The housing's 52 internal thread 112 and the external thread 176 of the bellows constitute an engagement assembly or pair configured to secure the bellows 54 in its collapsed position to the housing 52, the engagement assembly including an engagement element thereof carried by the housing 52, the internal thread 112, and a complemental engagement element carried by the bellows, the external thread 176 of the collar 174 of the open distal end 170. Alternate embodiments of a lid assembly constructed and arranged according to this disclosure can utilize other formats of engagement assemblies or engagement pairs to secure the open distal end 170 to the housing 52 to secure the bellows 54 in its collapsed position, such as one or more detent engagement pairs, pin-and-groove pairs, etc.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the invention, they are intended to be included within the scope thereof.

The invention claimed is:

1. A lid assembly for a container, comprising:

a housing including a closure, a first vent, and a second vent, the housing defining a receiving area and a gas flow pathway, the gas flow pathway extending between the first vent, allowing gas transfer between the receiving area and the gas flow pathway, and the second vent, allowing gas transfer between the gas flow pathway and an atmosphere;

an extensible and collapsible bellows coupled to the housing, the bellows including an open distal end open to the receiving area and the first vent and configured to fit over the container, and adjustable between an extended position, extended outward of the receiving area to the open distal end, and a collapsed position, compressed in the receiving area between the first vent and the open distal end; and the closure movable rotatably into and out of a closed position closing the first vent.

2. The lid assembly according to claim 1, further comprising an engagement assembly configured to secure the bellows in the collapsed position, the engagement assembly including an engagement element carried by the housing and a complemental engagement element carried by the bellows.

3. The lid assembly according to claim 2, wherein the engagement element comprising an internal thread and the complemental engagement element comprising an external thread, the internal thread configured to thread over the external thread.

4. The lid assembly according to claim 3, further comprising the housing and the bellows configured for relative rotation, allowing the external thread to thread over the internal thread in response to relative rotation between the housing and the bellows.

5. The lid assembly according to claim 4, further comprising the open distal end including a collar configured with the external thread.

6. The lid assembly according to claim 1, wherein the housing surrounds the bellows when the bellows is in the collapsed position.

7. The lid assembly according to claim 1, wherein the first vent comprises a pressure relief valve.

8. The lid assembly according to claim 1, further comprising the housing extending radially outward from the bellows.

9. The lid assembly according to claim 8, further comprising the gas flow pathway including a radial component extending radially outward to a circumferential component, the first vent allowing gas transfer between the receiving area and the radial component and the second vent allowing gas transfer between the circumferential component and the atmosphere.

10. The lid assembly according to claim 1, the bellows further comprising an open proximal end mounted for reciprocal movement through receiving area in opposition to the first vent, the open proximal end open to the receiving area, the first vent, and the open distal end.

11. The lid assembly according to claim 10, further comprising:

the receiving area defined by an annular sidewall extending between an annular step adjacent to a hole and a top wall between the gas flow pathway and the receiving area, the top wall configured with the first vent; and the open proximal end including a gasket within the receiving area, the gasket constrained for reciprocal movement along the annular sidewall by and between the annular step and the top wall.

12. A lid assembly for a container, comprising:

a housing including a closure, circumferentially spaced first vents, and circumferentially spaced second vents, the housing defining a receiving area and a gas flow pathway, the gas flow pathway extending between the first vents, allowing gas transfer between the receiving area and the gas flow pathway, and the second vents, allowing gas transfer between the gas flow pathway and an atmosphere;

an extensible and collapsible bellows coupled to the housing, the bellows including an open distal end open to the receiving area and the first vent and configured to fit over the container, and adjustable between an extended position, extended outward of the receiving area to the open distal end, and a collapsed position, compressed in the receiving area between the first vent and the open distal end; and the closure movable rotatably into and out of a closed position closing the first vents concurrently.

13. The lid assembly according to claim 12, further comprising an engagement assembly configured to secure the bellows in the collapsed position, the engagement assembly including an engagement element carried by the housing and a complemental engagement element carried by the bellows.

14. The lid assembly according to claim 13, wherein the engagement element comprising an internal thread and the complemental engagement element comprising an external thread, the internal thread configured to thread over the external thread.

15. The lid assembly according to claim 14, further comprising the housing and the bellows configured for relative rotation, allowing the external thread to thread over the internal thread in response to relative rotation between the housing and the bellows.

16. The lid assembly according to claim 15, further comprising the open distal end including a collar configured with the external thread.

17. The lid assembly according to claim 12, wherein the housing surrounds the bellows when the bellows is in the collapsed position.

18. The lid assembly according to claim 12, wherein the first vents each comprise a pressure relief valve.

19. The lid assembly according to claim 12, further comprising the housing extending radially outward from the bellows.

20. The lid assembly according to claim 19, further comprising the gas flow pathway including a radial component extending radially outward to a circumferential component, the first vents allowing gas transfer between the receiving area and the radial component and the second vents allowing gas transfer between the circumferential component and the atmosphere.

21. The lid assembly according to claim 12, the bellows further comprising an open proximal end mounted for reciprocal movement through receiving area in opposition to the first vents, the open proximal end open to the receiving area, the first vents, and the open distal end.

22. The lid assembly according to claim 21, further comprising:

the receiving area defined by an annular sidewall extending between an annular step adjacent to a hole and a top wall between the gas flow pathway and the receiving area, the top wall configured with the first vents; and the open proximal end including a gasket within the receiving area, the gasket constrained for reciprocal movement along the annular sidewall by and between the annular step and the top wall.

23. A lid assembly for a container, comprising:

a housing including a closure, a first vent, and a second vent, the housing defining a receiving area and a gas flow pathway, the gas flow pathway extending between the first vent, allowing gas transfer between the receiving area and the gas flow pathway, and the second vent, allowing gas transfer between the gas flow pathway and an atmosphere;

an extensible and collapsible bellows coupled to the housing, the bellows including an open distal end open to the receiving area and the first vent and configured to fit over the container, and adjustable between an extended position, extended outward of the receiving area to the open distal end, and a collapsed position, compressed in the receiving area between the first vent and the open distal end;

the closure movable into and out of a closed position closing the first vent; and the gas flow pathway including a radial component extending radially outward to a circumferential component, the first vent allowing gas transfer between the receiving area and the radial component and the second vent allowing gas transfer between the circumferential component and the atmosphere.

24. A lid assembly for a container, comprising:

a housing including a closure, circumferentially spaced first vents, and circumferentially spaced second vents, the housing defining a receiving area and a gas flow pathway, the gas flow pathway extending between the first vents, allowing gas transfer between the receiving area and the gas flow pathway, and the second vents, allowing gas transfer between the gas flow pathway and an atmosphere;

an extensible and collapsible bellows coupled to the housing, the bellows including an open distal end open to the receiving area and the first vent and configured to fit over the container, and adjustable between an extended position, extended outward of the receiving area to the open distal end, and a collapsed position, compressed in the receiving area between the first vent and the open distal end;

the closure movable into and out of a closed position closing the first vents concurrently; and the gas flow pathway including a radial component extending radially outward to a circumferential component, the first vents allowing gas transfer between the receiving area and the radial component and the second vents allowing gas transfer between the circumferential component and the atmosphere.

* * * * *